US005472821A

United States Patent [19]

Taguchi

[11] Patent Number: 5,472,821

[45] Date of Patent: Dec. 5, 1995

[54] HEAT-DEVELOPABLE DIFFUSION TRANSFER COLOR PHOTOGRAPHIC MATERIAL

[75] Inventor: Toshiki Taguchi, Kanagawa, Japan

[73] Assignee: Fuji Photo Film Co., Ltd., Kanagawa, Japan

[21] Appl. No.: 233,440

[22] Filed: Apr. 28, 1994

Related U.S. Application Data

[62] Division of Ser. No. 845,948, Mar. 4, 1992, Pat. No. 5,336,761.

[30] Foreign Application Priority Data

Mar. 5, 1991 [JP] Japan ..... 3-063925
May 1, 1991 [JP] Japan ..... 3-126553

[51] Int. Cl.[6] ..... G03C 7/388; G03C 8/10; G03C 8/40

[52] U.S. Cl. ..... 430/203; 430/220; 430/217; 430/222; 430/546; 430/944

[58] Field of Search ..... 430/203, 220, 430/222, 546, 944, 217

[56] References Cited

U.S. PATENT DOCUMENTS

| | | | |
|---|---|---|---|
| 4,619,892 | 10/1986 | Simpson et al. | 430/507 |
| 4,923,783 | 5/1990 | Kobayashi et al. | 430/222 |
| 5,026,634 | 6/1991 | Ono et al. | 430/223 |
| 5,047,314 | 9/1991 | Sakai et al. | 430/546 |
| 5,057,405 | 10/1991 | Shiba et al. | 430/944 |
| 5,100,759 | 3/1992 | Sato et al. | 430/944 |
| 5,108,882 | 4/1992 | Parton et al. | 430/508 |
| 5,126,235 | 6/1992 | Hioki et al. | 430/944 |
| 5,139,919 | 8/1992 | Taguchi et al. | 430/223 |
| 5,270,155 | 12/1993 | Ozaki et al. | 430/220 |
| 5,336,761 | 8/1994 | Ozaki et al. | 430/217 |

FOREIGN PATENT DOCUMENTS

| | | |
|---|---|---|
| 0109111 | 5/1984 | European Pat. Off. . |
| 0385496 | 9/1990 | European Pat. Off. . |

*Primary Examiner*—Richard L. Schilling
*Attorney, Agent, or Firm*—Sughrue, Mion, Zinn, Macpeak & Seas

[57] ABSTRACT

Disclosed is a diffusion transfer color photographic material at least having a light-sensitive silver halide, a binder, a non-diffusive dye donor compound capable of releasing or forming a diffusive dye in correspondence or reverse correspondence with the reaction of reducing the silver halide to silver, and a non-diffusive filter dye, on a support, in which the filter dye is in the form of an emulsified dispersion along with the dye donor compound. The color separatability of the processed material is good and the discrimination of the formed image is also good. The raw film of the material is free from lowering of the filter effect after storage. Also disclosed is a heat-developable color photographic material having at least two layers of a light-sensitive layer B having a peak of color sensitivity to a light of from 720 to 780 nm and a light-sensitive layer A having a peak of color sensitivity to a light of from 790 to 860 nm, on a support, in which the maximum sensitivity of the light-sensitive layer B is same as or lower than the maximum sensitivity of the light-sensitive layer A. The material has excellent time-dependent raw film storage stability. It may be developed with little temperature dependence and water amount dependence to give an image of high sharpness.

9 Claims, 1 Drawing Sheet

THE INVENTION

HEAT-DEVELOPABLE DIFFUSION TRANSFER COLOR PHOTOGRAPHIC MATERIAL

This is a divisional of application Ser. No. 07/845,948 filed Mar. 4, 1992, now U.S. Pat. No. 5,336,761.

FIELD OF THE INVENTION

The present invention relates to a diffusion transfer color photographic material and, in particular, to that having excellent color separability and image discriminability and also having excellent raw film storability.

The present invention also relates to a multi-layer heat-developable diffusion transfer color photographic material and, in particular, to that having excellent time-dependent raw film storage stability.

The present invention further relates to a heat-developable diffusion transfer color photographic material which may be developed with little dependence on temperature and water amount, which has excellent sharpness and which may be produced at a low manufacturing cost.

BACKGROUND OF THE INVENTION

Since a photographic method of using a silver halide is superior to any other photographic methods such as an electro-photographic method or a diazo-photographic method in terms of photographic characteristics such as sensitivity and gradation adjustment, it has heretofore been utilized most widely in the technical field. Recently, the technology for simply and rapidly obtaining a photographic image has been developed by exchanging the conventional wet processing treatment with a developer or the like in a method of forming a photographic image in a silver halide-containing photographic material for a dry processing treatment by heating or the like. In particular, color hard copies with a very high image quality can be obtained by this type of such silver halide photography. This type of photography is being studied and developed.

Heat-developable diffusion transfer color photographic materials are known in this technical field, and various heat-developable diffusion transfer color photographic materials and various processes of processing the photographic materials are described, for example, in *Syashin Kouqaku no Kiso* (Bases of Photographic Engineering), pp. 553–555 (published by Coma Publishing Co., Ltd., 1979), *Eizou Jyoho* (Picture Information), page 40 (published in April, 1978); Nebletts, *Handbook of Photography and Reprography*, 7th Ed., pages 32 to 33 (published by Van Nostrand Reinhold Company); U.S. Pat. Nos. 3,152,904, 3,301,678, 3,392,020 and 3,457,075; British Patents 1,131, 108 and 1,167,777; and Research Disclosure, No. 17029 (June, 1978; RD-17029), pages 9 to 15.

Recently, business image appliances, electronic still cameras, videos and facsimiles have been popularized by the development of office automation and, accordingly, the need for graphics has increased. In particular, with development of computer graphics as well as development and progress of image sensor technology and digital processing technology, the demand for obtaining color hard copies from image information in the form of electric signals is increasing.

Conventional color photographic materials generally have color sensitivity to blue, green and red. In order to form images on such color photographic materials from image information in the form of electric signals, a color CRT (cathode ray tube) may be used as a light source for exposure. However, a CRT is unsuitable for obtaining large-size prints.

Useful writing heads for the purpose of obtaining large-size prints include a light emission diode (LED) and a semiconductor laser. However, these opto-writing heads cannot emit blue light efficiently.

Therefore, for example, if light emission diodes (LED) are used, a color photographic material having three layers each as color-sensitized to near infrared, red and yellow colors, separately, must be exposed with a light source having a combination of three light emission diodes each emitting a near infrared ray (800 nm), a red ray (670 nm) and an yellow ray (570 nm), separately. Image recording systems are described in Nikkei New Material (issued Sep. 14, 1987), pages 47 to 57, and some have been put into practical use.

For example, a system of recording a color photographic material having three light-sensitive layers each having a different color sensitivity with a light source composed of three semiconductor lasers each respectively emitting a ray of 880 nm, 820 nm, and 760 nm, correspondingly to the three light-sensitive layers of the material, is described in JP-A 61-137149 (the term "JP-A" as used herein means an "unexamined published Japanese patent application").

A system of simply and rapidly obtaining a photographic image has been developed in accordance with the needs pertaining to color hard copies, by converting the conventional wet processing treatment with a developer or the like in a method of forming a photographic image in a silver halide-containing photographic material into an instant photographic system containing a developer in the photographic material itself or into a dry heat-development processing treatment by heating or the like. In the simple and rapid processing method, an image forming system by diffusion transfer process is frequently employed for the purpose of preventing stains of the printed images, which often occur during the printing-out step of the developed silver halide materials.

A diffusion transfer method involves a diffusive dye which is imagewise formed or released and the diffusive dye which is transferred to an image-receiving material having a mordant agent with water or a solvent. The details of this type of method are described in *Angew. Chem. Int. Ed. Engl.*, 22 (1983), 191.

The present invention is directed to diffusion transfer color photographic materials, which can be used when a color photographic material which may be applied to the above-mentioned writing heads (e.g., semiconductor laser and LED).

In order to achieve the above-mentioned color photographic material, it is necessary to select a three-color light source having a spectral wavelength distribution essentially in an infrared range of 600 nm or more and in a narrow wavelength range. Therefore, planning the spectral sensitivity of silver halides used in the photographic material is extremely difficult. Accordingly, a method of separating the plural color sensitivities of the material with filter dyes as incorporated therein or of sharpening the color sensitivities of the material with them has been employed in this technical field. The method has been described in U.S. Pat. No. 4,619,892 where the short wave length sensitivity of the two color sensitivities is elevated or filter layers are introduced into the photographic material.

The present applicant also investigated the method of using filter dyes. However, the filter dyes which are used in color papers in this technical field are soluble in water since they must be decolored after processing. If such water-soluble dyes are used in diffusion transfer color photographic materials, they would inconveniently and disadvantageously be transferred to image-receiving materials. Therefore, such water-soluble dyes cannot be used in diffusion transfer color photographic materials.

Consequently, introduction of an oil-soluble ballast group into filter dyes for the purpose of oil-protecting emulsification has been tried. However, when only this type of filter dye is emulsified and dispersed singly, it has been found that the half-value width of the peak of the color absorption is broadened because of the side-absorption which is possibly caused by an aggregate of the dye so that the intended color separation could not be attained. In addition, it has also been found that in the photographic material containing the emulsified dispersion of the filter dye, the filter dye is decomposed during storage of the raw film of the material.

The object of the present invention is to provide a diffusion transfer color photographic material having excellent color separability and color image discrimnability and also having excellent raw film storability. The "raw film storability" referred to herein means that the photographic properties of the raw photographic material do not significantly vary or fluctuate after the material has been stored for a long period of time of several months or more.

In addition, where a multi-layer color photographic material is exposed to three different spectral ranges to thereby separately form yellow, magenta and cyan colors therein, it is an important technique for color reproduction to separately form the respective colors without color mixing them.

In particular, where a light emission diode (LED) or a semiconductor laser (LD) is used as a light source for exposure of the material, it is inevitable to plan the three color sensitivities in a narrow spectral range in preparing the multi-layer color photographic material. The key is how to reduce the overlap of the respective color sensitivities with each other to improve the color separability of the material.

A method which meets this requirement, for example, is described in U.S. Pat. No. 4,619,892 which mentions stepwise elevation of the sensitivities in the short wavelength range and introduction of filter dyes in the photographic material.

However, it has been found that elevation of the sensitivities in the short wavelength range to ensure color separability of a multi-layer color photographic material defectively causes increase of Dmin which, in turn, adversely affects the time-dependent raw film storage stability.

In addition, where the photographic material is to have a difference in sensitivities as mentioned above, the problem arises where that the development characteristics of the respective light-sensitive layers differ from each other. In other words, the respective light-sensitive layers in the material would have different dependence on temperature and water amount for development so that the time-dependent fluctuation (in-day fluctuation and day-to-day fluctuation) of the color evenness and color balance in the picture plane of the material would be large defectively.

Accordingly, another object of the present invention is to provide a multi-layer heat-developable diffusion transfer color photographic material having excellent time-dependent raw film storage stability.

Still another object of the present invention is to provide a diffusion transfer color photographic material which may be developed with little dependence on temperature and water amount, which has excellent sharpness and which may be produced at a low manufacturing cost.

SUMMARY OF THE INVENTION

The above-mentioned objects and advantages are obtained by a diffusion transfer color photographic material comprising a light-sensitive silver halide emulsion, a binder, a non-diffusive dye donor compound capable of releasing or forming a diffusive dye in correspondence or reverse correspondence with reduction of silver halide to silver, and a non-diffusive filter dye, on a support, in which the filter dye is added in the form of an emulsified dispersion together with the dye donor compound.

As one preferred embodiment of the diffusion transfer color photographic material, the emulsified dispersion containing the filter dye is present in the layer containing the light-sensitive silver halide emulsion.

As another preferred embodiment, the total dry thickness of the layers to be coated on the side of the support on which the silver halide emulsion is provided is 15 μm or less, the photographic material is developed by heat-development and the processing temperature is from 50° C. to 250° C.

In addition, the above-mentioned objects and advantages are obtained by a diffusion transfer color photographic material comprising at least two layers of a light-sensitive layer B having a color sensitivity peak to light in the range from 720 to 780 nm and a light-sensitive layer A having a color sensitivity peak to light in the range from 790 to 860 nm, on a support, in which the maximum sensitivity of the light-sensitive layer B is same as or lower than the maximum sensitivity of the light-sensitive layer A.

As one preferred embodiment of the diffusion transfer color photographic material, the support is paper and has no anti-halation layer, and the light-sensitive layer A contains a filter dye capable of absorbing light in the range from 720 to 780 nm.

BRIEF DESCRIPTION OF THE DRAWINGS

FIG. 1-B shows the color sensitivities of a photographic material of the present invention.

Figure 1A:
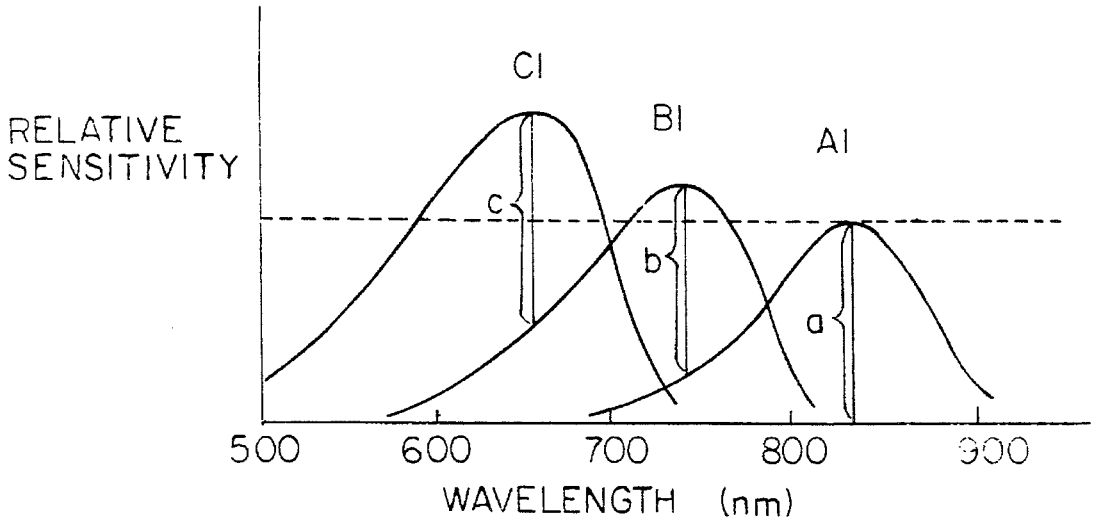
FIG. 1A PRIOR ART
FIG. 1-A graphically shows the color sensitivities of a conventional photographic material in which the sensitivities in the short wavelength range are gradually elevated so as to improve the color separatability of the material.

$A_1$ and $A_2$ each indicate a light-sensitive layer having a color sensitivity peak at 810 nm.

$B_1$ and $B_2$ each indicate a light-sensitive layer having a color sensitivity peak at 750 nm.

$C_1$ and $C_2$ each indicate a light-sensitive layer having a color sensitivity peak at 670 nm.

a, b and c each indicate the difference in the sensitivity between the overlapping adjacent layers.

DETAILED DESCRIPTION OF THE INVENTION

The present invention is explained concretely and in detail as follows.

Filter dyes usable in the present invention include filter dyes which have a colorant moiety, and since the filter dyes used in the present invention must not be transferred to image receiving materials during processing, they must have an oil-soluble residue (hereinafter referred to as a "ballast group"). Examples of these dyes include cyanine dyes as well as azomethine, indaniline, indophenol, azine, amidolazone and azo dyes as described in T. H. James, *Theory of the Photographic Process,* 4th Ed., MacMillan Publishers (1977) pp. 194 to 233 and 355 to 362. Suitable ballast groups are introduced in these dyes before use in the present invention.

In particular, for writing heads with light emission diodes (LED) or semiconductor lasers, filter dyes are frequently used for color separation in an infrared (IR) range. In such a case, dyes having an absorption maximum wavelength (Amax) in the range of 700 nm or more are selected. Examples of infrared dyes include those described in *Kinou Zairyo* (Functional Materials), published by CMC Co., Ltd., June, 1990, p. 64. The compounds described in the *Kinou Zairyo* can be used as the dye capable of absorbing light in the range from 720 to 780 nm.

Examples of filter dyes which can be used in the present invention include those of the following formula (A). Preferred examples of $R_1$, Y and X- of formula (A) are mentioned in the following table; however, these are not limitative.

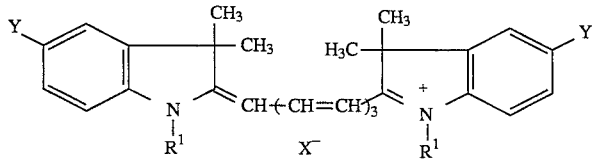

| Compound | $R^1$ | Y | $X^-$ |
|---|---|---|---|
| 1 | n-$C_{18}H_{37}$ | H | $ClO_4^-$ |
| 2 | 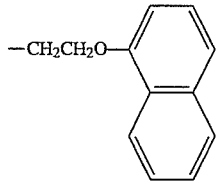 | H | $ClO_4^-$ |
| 3 | n-$C_8H_{17}$ | H | $ClO_4^-$ |
| 4 | $-CH_2-CH(C_2H_5)-(CH_2)_3CH_3$ | H | $PTS^-$ |
| 5 | $-CH(CH_3)_2-CH_2-C(CH_3)_2-CH_3$ | H | $PTS^-$ |
| 6 | $(CH_2)_2OC_2H_4OC_6H_{13}$ | H | $PTS^-$ |
| 7 | 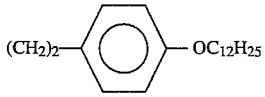 | H | $PTS^-$ |
| 8 | 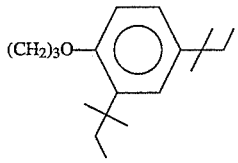 | H | $PTS^-$ |
| 9 | 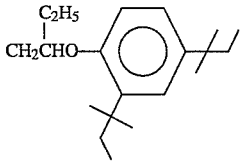 | H | $I^-$ |
| 10 | 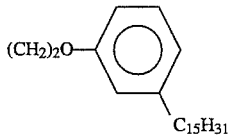 | H | $PF_6^-$ |
| 11 | $C_2H_5$ | $CO_2C_{12}H_{25}$ | $PF_6^-$ |
| 12 | " | $NHSO_2C_8H_{17}$ | $PTS^-$ |
| 13 | " | $NHCOC_{12}H_{25}$ | $PTS^-$ |

-continued
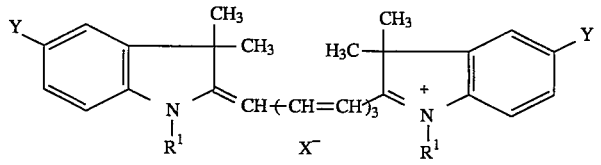
| Compound | $R^1$ | Y | $X^-$ |
|---|---|---|---|
| 14 | $(CH_2)_2OC(=O)-C_{17}H_{35}$ | H | $I^-$ |
| 15 | 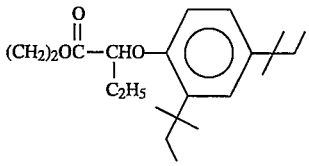 | H | $I^-$ |
| 16 | 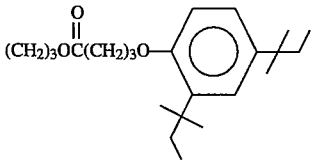 | H | 1/2 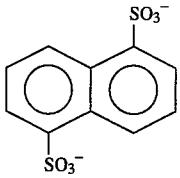 |
| 17 | 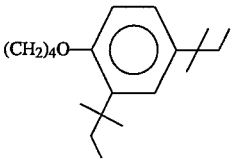 | H | $PTS^-$ |
| 18 | $(CH_2)_3O(CH_2)_{13}CH_3$ | H | $CF_3SO_3^-$ |
| 19 | $C_2H_5$ | $-COC_2H_4SO_2C_{14}H_{29}$ | $ClO_4^-$ |
| 20 | n-$C_{18}H_{37}$ | CN | $ClO_4^-$ |
| 21 | $CH_2CH(C_2H_5)(CH_2)_3CH_3$ | Cl | $I^-$ |
| 22 | $CH_3$ | 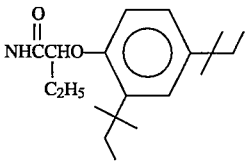 | $I^-$ |
Specific examples of compounds of formula (A) are mentioned below, which, however, are not limitative.

23
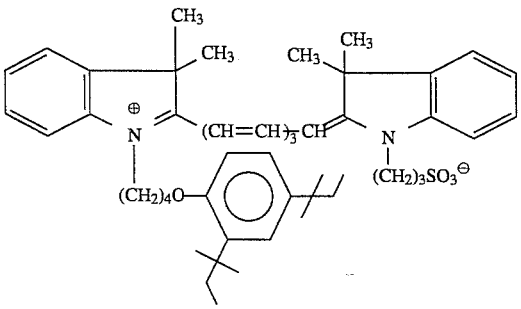
24
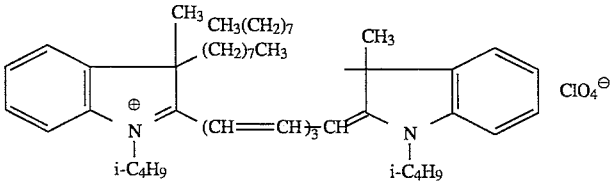
25
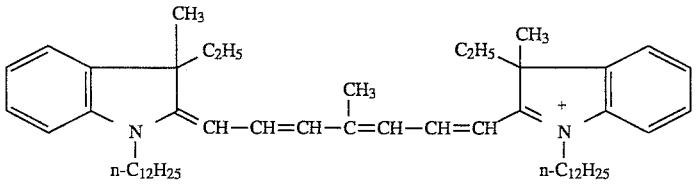
PTS⁻
26
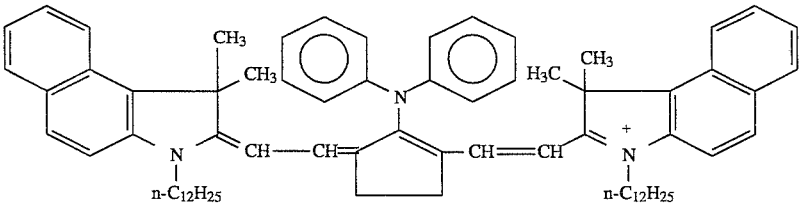
PTS⁻
PTS⁻ = 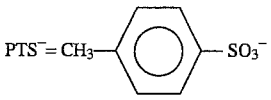
27
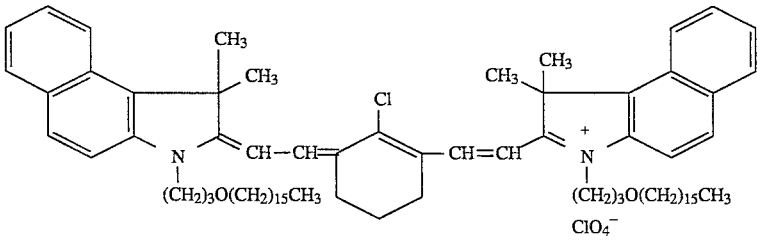
28
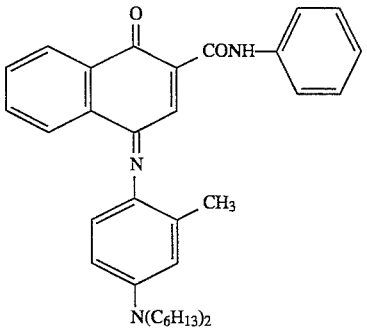

-continued

29

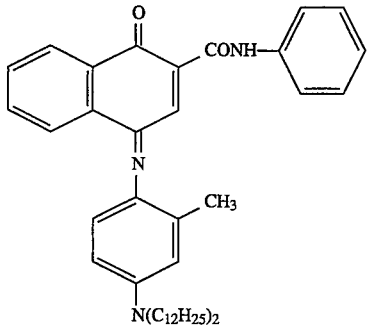

30

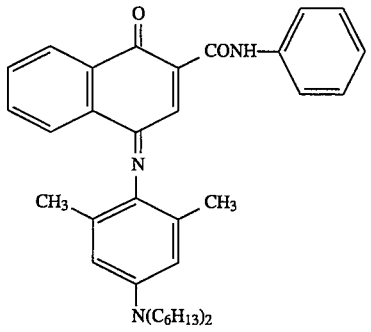

31

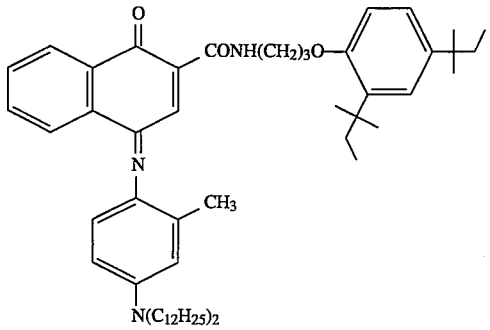

The above-mentioned filter dyes each have an absorption maximum falling within the wavelength range of from 730 to 850 nm, which can be produced with reference to the disclosures of the *Journal of the Chemical Society,* 189 (1933) and U.S. Pat. No. 2,895,955.

In the present invention, the above-mentioned filter dyes are used in the form of an emulsified dispersion along with non-diffusive dye donor compounds. Any known emulsification and dispersion of them is a known technology in this technical field. For this, any known methods, for example, the method described in U.S. Pat. No. 2,322,027 can be employed. This will be described in the working examples hereinafter.

Only by incorporating the filter dye in the form of an emulsified dispersion along with a dye donor compound into the photographic material of the present invention can the effect of the present invention be attained. If the filter dye and the dye donor compound are separately incorporated into the photographic material each in the form of an emulsified dispersion, the effect of the invention cannot be attained.

The filter dye and the dye donor compound are desired in the form of a co-emulsified dispersion in the photographic material, but a portion of the filter dye and dye donor compound may be in the form of a co-emulsified dispersion and the remaining portion may separately be in the form of a single dispersion. In the latter case, however, it is desired that all the filter dye is in the form of a co-emulsified dispersion with a part of the dye donor compound, and the remaining dye donor compound is in the form of a single dispersion.

The emulsified dispersion may be added to the at least one layer including one or more silver halide emulsion layers, colorant layers, interlayers and protective layers of the photographic material of the invention and is preferably added to silver halide emulsion layer(s).

The reasons why the emulsified dispersion is preferably added to silver halide emulsion layer(s) are because the reaction between a silver halide and a dye donor compound is most efficiently effected during development and because the sharpness of the photographic material is elevated because of the anti-irradiation effect by the filter dye. The latter effect is especially noticeable in the case of false color photographic materials.

The filter dyes for use in the present invention are desired to have a higher extinction coefficient. Accordingly, the amount of filter dye added to the photographic material of the present invention may be within in a broad range. For instance, in the case of a filter dye having a molar extinction coefficient ($\epsilon$) of from 10,000 to 500,000, the amount may be from 1 mg/m$^2$ to 10 g/m$^2$, preferably from 5 mg/m$^2$ to 500 mg/m$^2$.

The weight ratio of filter dye to the dye donor compound in the photographic material of the invention is preferably from 0.01/1 to 100/1, more preferably from 0.1/1 to 10/1.

The color photographic material of the present invention is a diffusion transfer type material, and it is used in an image forming method where an imagewise formed diffusive dye is transferred to an image-receiving material of a dye-fixing element. The color photographic material may be either in the form of an instant photographic system containing a developer therein or in the form of a dry-type heat-development system developed under heat. The system to which the photographic material of the present invention is applicable is not limited. However, the heat-development system is preferred.

The color photographic material of the present invention basically comprises a light-sensitive silver halide emulsion, a dye donor compound (which may be a reducing agent as mentioned hereinafter) a filter dye and a binder, and if desired, it may further contain an organic metal salt oxidizing agent. These components are generally added to the same layer but they may be separately added to different layers provided that they are in a reactable condition. For instance, a colored dye donor compound may be added to a layer below the silver halide emulsion layer whereby lowering of the sensitivity of the layer may be prevented.

A reducing agent is preferably incorporated into the photographic material, but it may be added from an external source, for example, from a dye-fixing material, which will be mentioned below, by diffusion.

In order to obtain colors of a broad range in a chromaticity diagram by using three primary colors of yellow, magenta and cyan, a combination of at least three silver halide emulsion layers each having a light-sensitivity in a different spectral region is used. For instance, a combination Of three layers of a blue-sensitive layer, a green-sensitive layer and a red-sensitive layer, and a combination of a green-sensitive layer, a red-sensitive layer and an infrared sensitive layer may be used. The respective light-sensitive layers may be arranged in any desired sequence as generally employed in ordinary color photographic materials. These layers each may have two or more plural layers each having a different sensitivity degree.

The color photographic material of the present invention may have various auxiliary layers such as protective layer, subbing layer, interlayer, anti-halation layer and backing layer. Additionally, the color photographic material has at least one layer containing a co-emulsified dispersion of a filter dye and a dye donor compound, because of the following reasons.

For instance, where a color layer B color-sensitized to a wavelength of 750 nm is provided over a layer A color-sensitized to a wavelength of 810 nm and the material is irradiated with light having a wavelength of 750 nm from the side of layer B, the color of layer A is mixed into the highly exposed region to which much light has been applied, so that color separation of the exposed material is insufficient. In particular, the tendency would be remarkable in the case of a photographic material where the sensitivity of layer A color-sensitized to light having a wavelength of 810 nm is high.

In this case, a dye, which does not have a substantial absorption near the color-sensitized peak of the layer A but which has an absorption maximum wavelength ($\lambda$max) in a wavelength region which is shorter than the color-sensitized peak of layer A and able to absorb the light as emitted from the light source for exposure of layer B, is incorporated into layer A or into an interlayer between layer A and layer B. The purpose is so that the color-sensitized part in the short wavelength range of layer A is cut to thereby improve the color separatability of the photographic material.

In a color photographic material having three different light-sensitive layers each of which has a different color sensitivity in a different spectral range to form yellow, magenta and cyan dyes therein, separate color formation of the three colors in the exposed material with no color mixing therebetween is an important requirement for color reproduction of the material. In other words, a technique to reduce overlap of the respective color sensitivities with each other is the key point to meet the requirement.

As a means of overcoming the problem and meeting the requirement discussed above various techniques are known including stepwise elevation of the color sensitivities in short wavelength range of the respective light-sensitive layers and introduction of a filter layer into a photographic material.

Figure 1B:
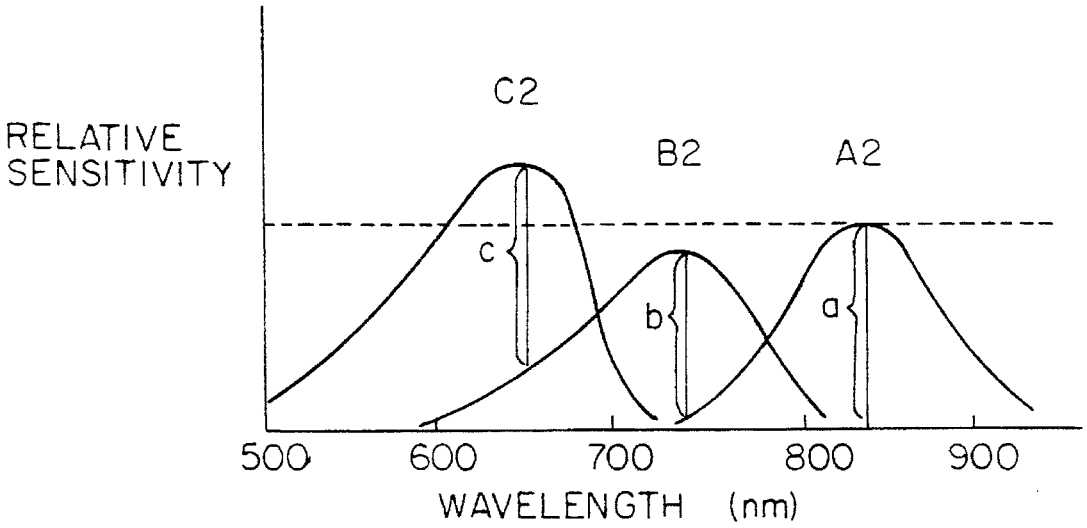

The conventional technique of stepwise elevation of the color sensitivities in the short wavelength range of the respective light-sensitive layers constituting a conventional photographic material for the purpose of improving the color separability is shown in FIG. 1-A. In constrast, FIG. 1-B shows the color sensitivities of the respective light-sensitive layers constituting a photographic material of the present invention.

In these drawings, the light-sensitive layers having a spectral sensitivity peak at 810 nm are referred to as light-sensitive layers $A_1$ and $A_2$; those having a spectral sensitivity peak at 750 nm are referred to as light-sensitive layers $B_1$ and $B_2$; and those having a spectral sensitivity peak at 670 nm are referred to as light-sensitive layers $C_1$ and $C_2$.

In general, the shape of spectral sensitivity curve is such that the foot of the curve is extended to the short wavelength side. Therefore, by planning the light-sensitive layers $A_1$, $B_1$ and $C_1$ in such a way that the sensitivities of the three layers are in the order of $C_1$, $B_1$ and $A_1$, as shown in FIG. 1-A, the sensitivity differences b and c between the overlapping adjacent layers may be made large so that the color separability of the photographic material composed of the layers $A_1$, $B_1$ and $C_1$ is improved.

In this case, the sensitivity differences a, b and c each have the necessary and indispensable dynamic range. However, in accordance with the color separation improving method, it is necessary to use a light-sensitive silver halide emulsion having a fairly high sensitivity in the $C_1$ layer and it is extremely difficult to maintain the Dmin value of the $C_1$ layer at a low level. In particular, elevation of the Dmin value of the layer is noticeable during storage of a raw film of the material.

In addition, it is also a problem to unify the development characteristic of the light-sensitive layers which noticeably differ from each other in the color sensitivity. As a result, the dependence on temperature and water amount in development of the photographic material would noticeably differ between the respective light-sensitive layers $A_1$, $B_1$ and $C_1$, so that a severe problem would occur whereby one-day fluctuation and day-to-day fluctuation of the color evenness and color balance in the picture plane of the photographic material are great.

In contrast to the conventional photographic material of FIG. 1-A, if the sensitivities of all the light-sensitive layers $A_2$, $B_2$ and $C_2$ could be planned to be almost the same, as shown in FIG. 1-B, the above-mentioned defective problem could be overcome.

In order to ensure the sensitivity difference b without making the key sensitivity of the layer $B_2$ higher than the sensitivity of the layer $A_2$, various means can be employed.

For instance, sensitizing dyes capable of making the spectral sensitivity of the layer $A_2$ rapidly lowered in the short wavelength side (or that is, the sensitivity is sharpened as a whole) are used.

However, the disclosed means are not limitative. In the illustrated embodiment, the maximum spectral sensitivity of the light-sensitive layer $C_2$ is set at 670 nm, but it is not limitative. The maximum spectral sensitivity of the layer $C_2$ may fall within the range of 710 nm or less.

As one means of obtaining the spectral sensitivity characteristic of the illustrated light-sensitive layer $A_2$, a method of color-sensitizing the silver halide emulsion sensitive to a longest wavelength light with a sensitizing dye of the following general formula (I) can be used:

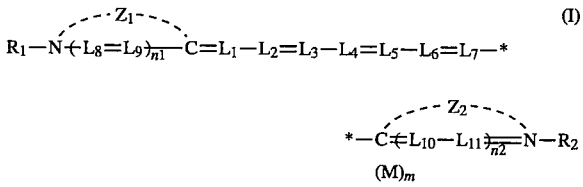

(I)

where $Z_1$ and $Z_2$ each represent an atomic group necessary for forming a 5-membered or 6-membered nitrogen-containing heterocyclic group;

$L_1$, $L_2$, $L_3$, $L_4$, $L_5$, $L_6$, $L_7$, $L_8$, $L_9$, $L_{10}$ and $L_{11}$ each independently represent a methine group or a substituted methine group, provided that either one group of $L_2$ and $L_4$, and $L_3$ and $L_5$ is bonded to each other via a group, $Q_1$ or $Q_2$, to form a ring;

$Q_1$ and $Q_2$ each represent an atomic group capable of forming a 5-, 6- or 7-membered ring;

$R_1$ and $R_2$ each represent an alkyl group, and may be the same or different;

$n_1$ and $n_2$ each represent 0 or 1;

M represents a pair ion for neutralizing the charge of the compound; and m represents a number necessary for neutralizing the intramolecular charge.

Next, compounds of formula (I) will be explained in detail hereunder.

Preferably, $R_1$ and $R_2$ each are an unsubstituted alkyl group having 18 or less carbon atoms (e.g., methyl, ethyl, propyl, butyl, pentyl, octyl, decyl, dodecyl, octadecyl), or a substituted alkyl group (having substituent(s) selected from a carboxyl group, a sulfo group, a cyano group, a halogen atom (e.g., fluorine, chlorine, bromine), a hydroxyl group, an alkoxycarbonyl group having 8 or less carbon atoms (e.g., methoxycarbonyl, ethoxycarbonyl, phenoxycarbonyl, benzyloxycarbonyl ), an alkoxy group having 8 or less carbon atoms (e.g., methoxy, ethoxy, benzyloxy, phenethyloxy), a monocyclic or bicyclic aryloxy group having 18 or less carbon atoms (e.g., phenoxy, p-tolyloxy, 1-naphthoxy, 2-naphthoxy ), an acyloxy group having 3 or less carbon atoms (e.g., acetyloxy, propionyloxy), an acyl group having 8 or less carbon atoms (e.g., acetyl, propionyl, benzoyl, mesyl), a carbamoyl group (e.g., carbamoyl, N,N-dimethylcarbamoyl, morpholinocarbonyl, piperidinocarbonyl), a sulfamoyl group (e.g., sulfamoyl, N , N-dimethylsulfamoyl, morpholinosulfonyl, piperidinosulfonyl), an aryl group having 10 or less carbon atoms (e.g., phenyl, 4-chlorophenyl, 4-methylphenyl, α-naphthyl), and an alkylthio group having 10 or less carbon atoms (e.g., methylthio, 2-(methylthio)ethylthio, 2-(hydroxyethylthio)ethylthio)).

More preferably, $R_1$ and $R_2$ each are an unsubstituted alkyl group (e.g., methyl, ethyl, n-propyl, n-butyl, n-pentyl, n-hexyl), a carboxyalkyl group (e.g., 2-carboxyethyl, carboxymethyl), a sulfoalkyl group (e.g., 2-sulfoethyl, 3-sulfopropyl, 4-sulfobutyl, 3-sulfobutyl), an aryloxy-substituted alkyl group (e.g., 2-(1-naphthoxy)ethyl, 2-(2-naphthoxy-)ethyl, 2-phenoxypropyl, 3-( 1-naphthoxy)propyl), or a sulfido-substituted alkyl group (e.g., 2-methylthioethyl, 2-(2-methylthioethylthio)ethyl, 2-(2-hydroxyethylthio)ethyl, 3-(2-methylthioethyl)propyl).

The atomic group represented by $Q_1$ or $Q_2$ is preferably capable of forming a 5-membered or 6-membered ring, which may contain oxygen atom or nitrogen atom as the ring-constituting atom.

Especially preferred examples of the ring to be formed by $Q_1$ or $Q_2$ are mentioned below.

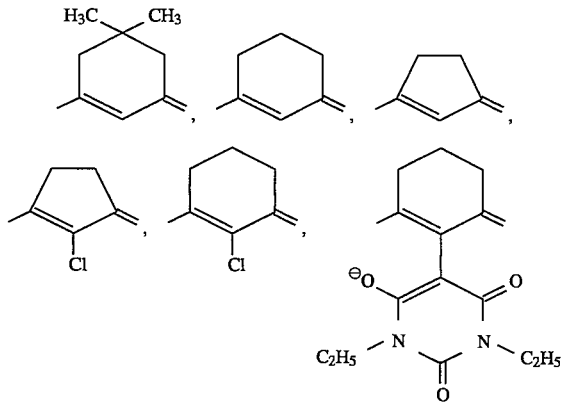

M and m of formula (I) indicate the presence or absence of cation or anion, which are necessary for neutralizing the ionic charge of the dye. Whether the dye is cationic or anionic or whether or not the dye has net ionic charges depends upon the auxochromes and substituents therein. Typical cations are inorganic or organic ammonium ions and alkali metal ions. Anions may be either inorganic anions or organic anions. Examples include halide ions (e.g., fluoride ion, chloride ion, bromide ion, iodide ion ), substituted arylsulfonate ions (e.g., p-toluenesulfonate ion, p-chlorobenzenesulfonate ion), aryldisulfonate ions (e.g., 1,3-benzenedisulfonate ion, 1,5-naphthalenedisulfonate ion, 2,6-naphthalenedisulfonate ion), alkyl sulfate ions (e.g., methyl sulfate ion), sulfate ions, thiocyanate ions, perchlorate ions, tetrafluoroborate ions, picrate ions, acetate ions, and trifluoromethanesulfonate ions.

Preferred examples are ammonium ions, iodide ions, and p-toluenesulfonate ions.

In formula (I), the nucleus formed by $Z_1$ or $Z_2$ includes, for example, a thiazole nucleus, a benzothiazole nucleus, a naphthothiazole nucleus, a thiazoline nucleus, an oxazole nucleus, a benzoxazole nucleus, a naphthoxazole nucleus, an oxazoline nucleus, a selenazole nucleus, a benzoselenazole nucleus, a naphthoselenazole nucleus, a selenazoline nucleus, a tellurazole nucleus, a benzotellurazole nucleus, a naphthotellurazole nucleus, a tellurazoline nucleus, a 3,3-dialkylindolenine nucleus, an imidazole nucleus, a benzimidazole nucleus, a naphthoimidazole nucleus, a pyridine nucleus, a quinoline nucleus, an isoquinoline nucleus, an imidazo[4,5-b]quinoxazoline nucleus, an oxadiazole nucleus, a thiadiazole nucleus, a tetrazole nucleus, and a pyrimidine nucleus.

Examples of the thiazole nucleus, include unsubstituted thiazole, 4-methylthiazole, 4-phenylthiazole, 4,5-dimethylthiazole, and 4,5-diphenylthiazole.

Examples of the benzothiazole nucleusinclude unsubstituted benzothiazole, 4-chlorobenzothiazole, 5-chlorobenzothiaozle, 6-chlorobenzothiazole, 5-nitrobenzothiazole, 4-methylbenzothiazole, 5-methylbenzothiazole, 6-methylbenzothiazole, 5-bromobenzothiaozle, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiaozle, 5,6-dimethylbenzothiazole, 5,6-dimethoxybenzothiazole, 5-hydroxy-6-methylbenzothiazole, tetrahydrobenzothiazole, and 4-phenylbenzothiazole.

Examples of the naphthothiazole nucleus include naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, and 5-methoxynaphtho[2,3-d]thiazole.

Examples of the thiazoline nucleus include unsubstituted thiazoline, 4-methylthiazoline, and 4-nitrothiazoline.

Examples of the oxazole nucleus include unsubstituted oxazole, 4-methyloxazole, 4-nitrooxazole, 5-methyloxazole, 4-phenyloxazole, 4,5-diphenyloxazole, and 4-ethyloxazole. Examples of the benzoxazole nucleus include unsubstituted benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenoxazole, 6-methoxybenzoxazole, 6-hydroxybenzoxazole, 5,6-dimethylbenzoxazole, 4,6-dimethylbenzoxazole, and 5-ethoxybenzoxazole.

Examples of the naphthoxazole nucleus include naphtho[2,1-d]oxazole, naphtho[1,2-d]oxazole, naphtho[2,3-d]oxazole, and 5-nitronaphtho[2,1-d]oxazole.

Examples of the oxazoline nucleus include 4,4-dimethyloxazoline.

Examples of the selenazole nucleus include 4-methylselenazole, 4-nitroselenazole, and 4-phenylselenazole. Examples of the benzoselenazole nucleus include unsubstituted benzoselenazole, 5-chlorobenzoselenazole, 5-nitrobenzoselenazole, 5-mehtoxybenzoselenazole, 5-hydroxybenzoselenazole, 6-nitrobenzoselenazole, 5-chloro-6-nitrobenzoselenazole, and 5,6-dimethylbenzoselenazole.

Examples of the naphthoselenazole nucleus include naphtho[2,1-d]selenazole and naphtho[1,2-d]selenazole.

Examples of the selenazoline nucleus include unsubstituted selenazoline and 4-methylselenazoline.

Examples of the tellurazole nucleus include unsubstituted tellurazole, 4-methyltellurazole, and 4-phenyltellurazole.

Examples of the benzotellurazole nucleus include unsubstituted benzotellurazole, 5-chlorobenzotellurazole, 5-methylbenzotellurazole, 5,6-dimethylbenzotellurazole, and 6-methoxybenzotellurazole. Examples of the naphthotellurazole nucleus include naphtho[2,1-d]tellurazole, and naphtho[1,2-d]tellurazole.

Examples of the tellurazoline nucleus include unsubstituted tellurazoline and 4-methyltellurazoline.

Examples of the 3,3-dialkylindolenine nucleus include 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl- 5-methoxyindolenine, 3,3,5-trimethylindolenine, and 3,3-dimethyl-5-chloroindolenine.

Examples of the imidazole nucleus include 1-alkylimidazoles, 1-alkyl-4-phenylimidazoles, and 1-arylimidazoles. Examples of the benzimidazole nucleus include 1-alkylbenzimidazoles, 1-alkyl-5-chlorobenzimidaozles, 1-alkyl-5,6-dichlorobenzimidazoles, 1-alkyl-5-methoxybenzimidazoles, 1-alkyl-5-cyanobenzimidaozles, 1-alkyl-5-fluorobenzimidazoles, 1-alkyl- 5-trifluoromethylbenzimidazoles, 1-alkyl-6-chloro-5-cyanobenzimidazoles, 1-alkyl-6-chloro-5-trifluoromethylbenzimidazoles, 1-allyl-5,6-dichlorobenzimidazole, 1-allyl-5-chlorobenzimidazole, 1-arylbenzimidazoles, 1-aryl-5-chlorobenzimidazoles, 1-aryl- 5,6-dichlorobenzimidazoles, 1-aryl-5-methoxybenzimidazoles, and 1-aryl-5-cyanobenzimidazoles. Examples of the naphthoimidazole nucleus include 1-alkylnaphtho[1,2-d]imidazoles, and 1-arylnaphtho[1,2-d]imidazoles.

The alkyl moiety in the above-mentioned groups is preferably an alkyl moiety having from 1 to 8 carbon atoms, for example, an unsubstituted alkyl group such as methyl, ethyl, propyl, isopropyl Or butyl group, or a hydroxyalkyl group such as 2-hydroxyethyl or 3-hydroxypropyl group. Especially preferred are methyl and ethyl groups. The aryl moiety in the above-mentioned groups is preferably a phenyl group, a halogen-substituted phenyl group (e.g., chloro-substituted phenyl), an alkyl-substituted phenyl group (e.g., methyl-substituted phenyl), or an alkoxy-substituted phenyl group (e.g., methoxy-substituted phenyl).

Examples of the pyridine nucleus include 2-pyridine, 4-pyridine, 5-methyl-2-pyridine, and 3-methyl-4-pyridine.

Examples of the quinoline nucleus include 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline. Examples of the isoquinoline nucleus include 6-nitro-1-isoquinoline, 3,4-dihydro-1-isoquinoline, and 6-nitro-3-isoquinoline.

Examples of the imidazo[4,5-b]quinoxaline nucleus include 1,3-diethylimidazo[4,5-b]quinoxaline, and 6-chloro- 1,3-diallylimidazo[4,5-b]quinoxaline.

Of the above-mentioned nuclei, as the nucleus to be formed by $Z_1$ or $Z_2$, the preferred nuclei are a benzothiazole nucleus, a naphthothiazole nucleus, a benzoxazole nucleus, a naphthoxazole nucleus, and a benzimidazole nucleus. Especially preferred is a benzothiazole nucleus.

$L_1$, $L_2$, $L_3$, $L_4$, $L_5$, $L_6$, $L_7$, $L_8$, $L_9$, $L_{10}$ and $L_{11}$ each represent a methine group, or a substituted methine group, for example, as substituted by one or more substituents selected from a substituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperazino) and an alkylthio group (e.g., methylthio, ethylthio) and may form a ring together with other methine group by $Q_1$ or $Q_2$.

Specific formulae of formula (I) and examples of dyes of formula ( I ) are mentioned below, which, however, are not intended to restrict the scope of the present invention. In the following formulae, Ph indicates a phenyl group.

(I-A)

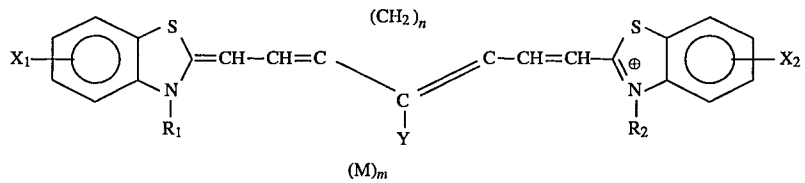

| Compound No. | $R_1$ | $R_2$ | $X_1$ | $X_2$ | Y | n | M | m |
|---|---|---|---|---|---|---|---|---|
| I-1 | $C_2H_5$ | $C_2H_5$ | H | H | H | 2 | $I^{\ominus}$ | 1 |
| I-2 | " | " | " | " | $N(CH_3)(ph)$ | 2 | " | " |
| I-3 | " | " | " | " | Cl | 3 | " | " |
| I-4 | $CH_2CO_2H$ | " | " | " | $N-ph_2$ | 2 | $Br^{\ominus}$ | 1 |
| I-5 | $(CH_2)_3SO_3^{\ominus}$ | " | " | " | H | 2 | $Cl^{\ominus}$ | 1 |
| I-6 | $(CH_2)_4CH_3$ | " | 6-$CH_3$ | " | " | 3 | $H_3C-C_6H_4-SO_3^{\ominus}$ | 1 |
| I-7 | $(CH_2)_4SO_3^{\ominus}$ | $(CH_2)_4SO_3^{\ominus}$ | H | " | $OCH_3$ | 3 | $HN(C_2H_5)_3^{\ominus}$ | 1 |
| I-8 | $CH_3$ | $C_2H_5$ | 6,7-benzo | 5-$CH_3$ | $CH_3$ | 4 | $I^{\ominus}$ | 1 |
| I-9 | $-(CH_2)_2O-$ naphthyl | $C_2H_5$ | H | H | H | 3 | $I^{\ominus}$ | 1 |
| I-10 | $-(CH_2)_2O-$ naphthyl | $-(CH_2)_2O-$ naphthyl | H | H | H | 3 | $I^{\ominus}$ | 1 |

-continued
| | | | | | | | | |
|---|---|---|---|---|---|---|---|---|
| I-11 | $-(CH_2)_2S(CH_2)_2SCH_3$ | $-(CH_2)_2S(CH_2)_2SCH_3$ | 6-$CH_3$ | 6-$CH_3$ | H | 3 | $I^{\ominus}$ | 1 |
| I-12 | 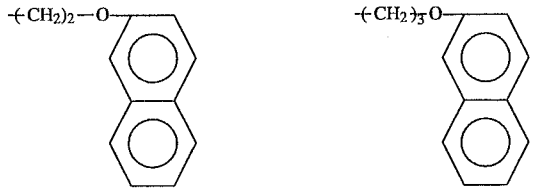 | | H | H | H | 3 | $I^{\ominus}$ | 1 |
| I-13 | 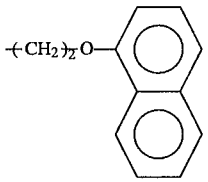 | $-(CH_2)_3S(CH_2)_2SCH_3$ | H | H | H | 3 | $I^{\ominus}$ | 1 |
| I-14 | 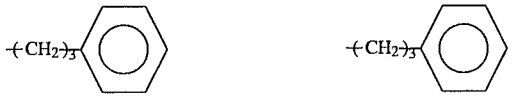 | | H | H | H | 3 | $I^{\ominus}$ | 1 |
| I-15 | $-(CH_2)_2S(CH_2)_2S(CH_2)_2CH_3$ | $-(CH_2)_2S(CH_2)_2S(CH_2)_2CH_3$ | H | H | H | 3 | $I^{\ominus}$ | 1 |
I-16
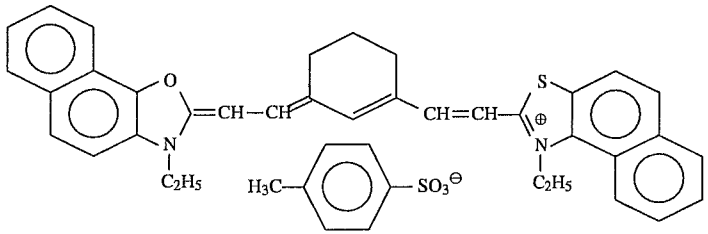
I-17
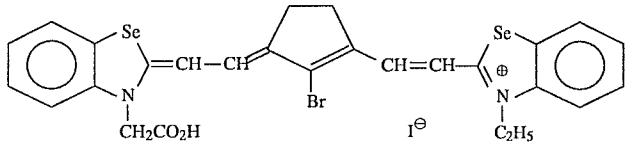

-continued
I-18
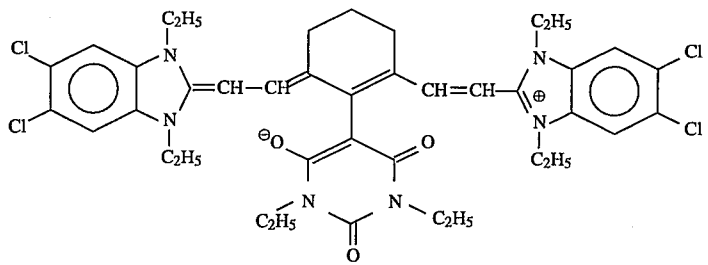
I-19
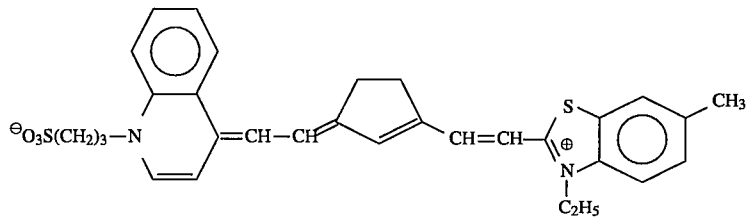

(I-B)
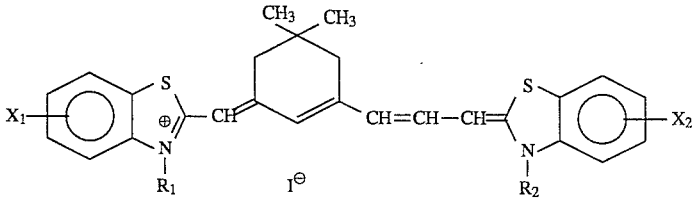
| Compound No. | $R_1$ | $R_2$ | $X_1$ | $X_2$ |
|---|---|---|---|---|
| I-20 | $C_2H_5$ | $-(CH_2)_2O-$ 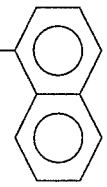 | 6-$OCH_3$ | 6-$OCH_3$ |
| I-21 | $C_2H_5$ | $-(CH_2)_2O-$ 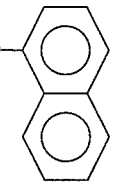 | 6,7-benzo | 5,6-($OCH_3$) |
| I-22 | $-(CH_2)_2O-$ 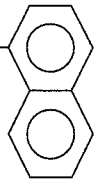 | $-(CH_2)_2O-$ 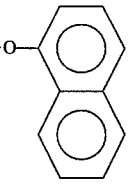 | 6,7-benzo | 5,6-($OCH_3$) |
| I-23 | $-(CH_2)_2S(CH_2)_2S-(CH_2)_2OH$ | $-(CH_2)_2O-$ 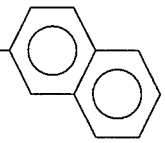 | 6,7-benzo | 6-$CH_3$ |
| I-24 | $-(CH_2)_3S(CH_2)_2CH_3$ | $-(CH_2)_2O-$ 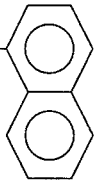 | 6,7-benzo | 6-$CH_3$ |
| I-25 | $-(CH_2)_2O-$ 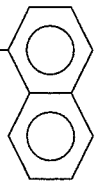 | $-(CH_2)_2O-$ 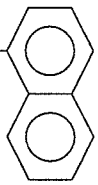 | 6-$OCH_3$ | 6,7-benzo |
| I-26 | $-(CH_2)_3O-$ 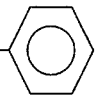 | $-(CH_2)_3O-$ 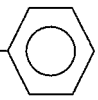 | 5,6-$(OCH_3)_2$ | 6,7-benzo |
| I-27 | $-(CH_2)_2O-$ 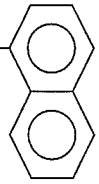 | $-(CH_2)_2O-$ 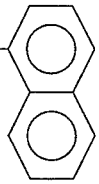 | H | H |

-continued (I-B)

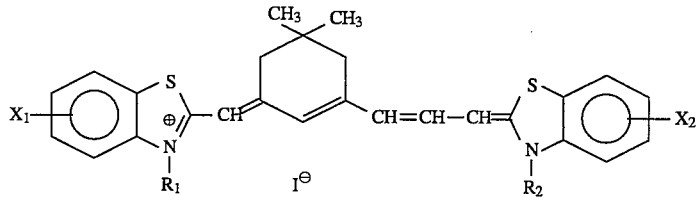

| Compound No. | $R_1$ | $R_2$ | $X_1$ | $X_2$ |
|---|---|---|---|---|
| I-28 | $C_2H_5$ | 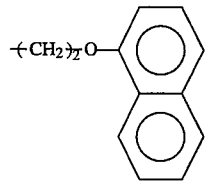 | H | H |

Dyes of formula (I) can be produced in accordance with the methods described in the following literature:

*Zh. Org. Khim.*, Vol. 17, NO. 1, pp. 167 to 169 (1980); *ibid.*, Vol. 15, No. 2, pp. 400 to 407 (1979); *ibid.*, Vol. 14, No. 10, pp. 2214 to 2221 (1978); *ibid.*, Vol. 13, No. 11, pp. 2440 to 2443 (1977); *ibid.*, Vol. 19, No. 10, pp. 2134 to 2142 (1983); *Ukr. Khim. Zh.*, Vol. 40, No. 6, pages 625 to 629 (1974); Khim. *Geterotsikl. Soedin.*, No. 2, pp. 175 to 178 (1976); USSR Patents 420,643 and 341,823; JP-A 59-217761; U.S. Pat. Nos. 4,334,000, 3,671,648, 3,623,881 and 3,573,921; European Patents 288,261A1, 102,781A2 and 102,781A2; and JP-B 49-46930 (the term "JP-B" as used herein means an "examined Japanese patent publication").

The sensitizing dyes of the present invention can be used singly or in combination of them, or they may be used along with known sensitizing dyes other than those of the present invention.

Dyes which do not have a color-sensitizing activity by themselves or compounds which do not substantially absorb visible rays but which show a super-color sensitizing activity may be incorporated into the silver halide emulsion along with sensitizing dyes. (For instance, examples of these dyes or compounds include those described in U.S. Pat. No. 3,615,641 and JP-A 63- 3145.)

The time for adding these sensitizing dyes into emulsions may be before or after chemical ripening of emulsions. In addition, it may be before or after formation of nuclei of silver halide grains, in accordance with U.S. Pat. Nos. 4,183,756 and 4,225,666. The amount of dye added is generally from about $10^{-8}$ to about $10^{-2}$ mol per mol of silver halide.

The silver halide of the silver halide emulsion for use in the present invention includes silver chloride, silver bromide, silver iodobromide, silver chlorobromide, silver chloroiodide and silver chloroiodobromide.

The silver halide emulsion used in the present invention may be either a surface latent image type emulsion or an internal latent image type emulsion. The latter internal latent type emulsion is used as a direct reversal emulsion, in combination with a nucleating agent or with light fogging. The emulsion may also be a core/shell emulsion in which the inside phase and the surface phase of each grain are different from each other. The silver halide emulsion may be either monodispersed or polydispersed. A .mixture of plural monodispersed emulsions may also be used. The grain size of emulsion grains may be preferably from 0.1 to 2 μm, more preferably from 0.2 to 1.5 μm. The crystal habit of silver halide grains may be a cubic, octahedral or tetradecahedral shape, or a tabular shape having a high aspect ratio.

Silver halide emulsions as described in U.S. Pat. No. 4,500,626 (column 50) and U.S. Pat. No. 4,628,021, Research Disclosure (hereinafter referred to as RD), No. 17,029 (1978), and JP-A 62-253159 may be used in the present invention.

The silver halide emulsions used may be primitive. In general, however, they are chemically sensitized before use. For instance, any known sulfur sensitization, reduction sensitization and noble metal sensitization, which are generally applied to emulsions of ordinary photographic materials, can be employed singly or in combination. Such chemical sensitization may also be effected in the presence of a nitrogen-containing heterocyclic compound as described in JP-A 62-253159.

The amount of light-sensitive silver halide coated in preparing the photographic material used in the present invention may be from 1 mg/m$^2$ to 10 g/m$^2$ as silver (i.e., based on the content of silver).

Silver halides other than those color-sensitized with a sensitizing dye of the above-mentioned formula (I), which may be used in the present invention, may be color-sensitized with methine dyes or others. Examples of usable dyes for this purpose include cyanine dyes, merocyanine dyes, complex cyanine dyes, complex merocyanine dyes, honopolar cyanine dyes, hemicyanine dyes, styryl dyes and hemioxonol dyes.

Examples of sensitizing dyes include those described in U.S. Pat. No. 4,617,257, JP-A 59-180550 and 60- 140335, and Research Disclosure (RD) No. 17029 (1978), pages 12 and 13.

The photographic material of the present invention may contain an organic metal salt, as an oxidizing agent, along with a light-sensitive silver halide of the silver halide emulsion. In particular, incorporation of such an organic metal salt into a heat-development photographic element of the invention is preferred. Organic silver salts are especially preferred.

Examples of organic compounds used for forming such organic silver salt oxidizing agents include benzotriazoles, fatty acids and other compounds described in U.S. Pat. No. 4,500,626 (columns 52 to 53). In addition, silver salts of carboxylic acids containing an alkynyl group(s) such as silver phenylpropiolate, as described in JP-A 60-113235, as well as acetylene silver as described in JP-A 61-249044 are also useful. Two or more kinds of organic silver salts may be employed in combination.

The amount of the above-mentioned organic silver salt may be added to the emulsion in an amount of from 0.01 to 10 mols, preferably from 0.01 to 1 mol, per mol of the light-sensitive silver halide in the emulsion. The total amount of the light-sensitive silver halide and the organic silver salt to be coated is suitably from 50 mg/m$^2$ to 10 g/m$^2$, as silver.

Various antifoggants and photographic stabilizers may be used in the present invention. Examples include azoles and azaindenes described in RD No. 17643 (1978), pages 24 and 25; nitrogen-containing carboxylic acids and phosphoric acids described in JP-A 59-168442; mercapto compounds and metal salts thereof, as described in JP-A 59-111636; and acetylene compounds described in JP-A 62-87957.

The reducing agent which can be used in the present invention include those which are known in the field of diffusion transfer color photographic materials and heat-developable photographic materials. The reducing agent also includes the dye donor compounds having a reducing property, which will be mentioned hereunder. In this case, any other reducing agent can be used, if desired, in combination with the reducing dye donor compound. In addition, reducing agent precursors which do not have a reducing property by themselves but may express a reducing capacity with the aid of a nucleating reagent or under heat during the step of development may also be employed.

Examples of the reducing agents which can be employed in the present invention include reducing agents and reducing agent precursors as described in U.S. Pat. No. 4,500,626 (columns 49 and 50), U.S. Pat. No. 4,483,914 (columns 30 and 31), U.S. Pat. Nos. 4,330,617 and 4,590,152, JP-A 60-140355 (pages 17 and 18), 57-40245, 56-138736, 59-178458, 59-53831, 59-182449, 59-182450, 60-119555, 60-128436 through 60-128439, 60- 198540, 60-181742, 61-259253, 62-244044, 62-131253 through 62-131256 and European Patent 220,746A2 (pages 78 to 96).

A combination of various reducing agents as described in U.S. Pat. No. 3,039,869 can also be employed.

Where non-diffusive reducing agents are used in accordance with the present invention, an electron-transmitting agent and/or an electron-transmitting agent precursor can be used, if desired, in combination with the reducing agent for the purpose of accelerating the movement of electrons between the non-diffusive reducing agent and the developable silver halide.

The electron-transmitting agent or precursor thereof which can be used for the purpose can be selected from the above-mentioned reducing agents and precursors thereof. The electron-transmitting agent or precursor thereof is preferably a higher mobility than the non-diffusive reducing agent (electron donor). More preferable electron-transmitting agents are 1-phenyl-3-pyrazolidones and aminophenols.

The non-diffusive reducing agent (electron donor) which can be employed in combination with the electron-transmitting agent may include any of the above-mentioned reducing agents which are not substantially mobile in the layers of a photographic element. Preferably, hydroquinones, sulfonamidophenols, sulfonamidonaphthols, compounds described in JP-A 53-110827 as electron donors, as well as non-diffusive and reducing dye donor compounds which will be mentioned hereunder are employed.

In accordance with the present invention, the amount of the reducing agent which can be added is from 0.001 to 20 mols, especially preferably from 0.01 to 10 mols, per mol of silver.

Examples of the non-diffusive dye donor compound which can be used in the present invention include compounds capable of imagewise releasing or diffusing a diffusive dye as well as compounds capable of releasing a mobile dye in correspondence or reverse correspondence with the reaction of reducing a silver ion into silver under a high-temperature condition. The compounds include those represented by formula (LI):

$$(\text{Dye-Y})_n\text{-Z} \qquad \text{(LI)}$$

wherein Dye represents a dye group or dye precursor group whose wavelength has been shortened temporarily; Y represents a chemical bond or a linking group; Z represents a group which either causes an imagewise differential in the diffusibility of the compound $(\text{Dye-Y})_n$-Z in correspondence or reverse correspondence with a photosensitive silver salt carrying a latent image or releases the Dye and causes a differential in diffusibility between the released Dye and $(\text{Dye-Y})_n$-Z; and n represents 1 or 2, and when n is equal to 2, the two Dye-Y groups may be same as or different from each other.

Specific examples of the dye donor compounds of the formula (LI) include the following compounds (1) through (5) are mentioned. The compounds (1) through (3) are those capable of forming a diffusive color image (positive color image) in reverse correspondence with development of silver halide; and the compounds (4) and (5) are those of forming a diffusive color image (negative color image) in correspondence with development of silver halide.

(1) Color-developing agents comprising a combination of a hydroquinone developing agent and a dye component, as described in U.S. Pat. Nos. 3,134,764, 3,362,819, 3,597,200, 3,544,545 and 3,482,972. The color-developing agents are diffusive under an alkaline condition but become non-diffusive after reacted with a silver halide.

(2) Non-diffusive compounds which may release a diffusive dye under an alkaline condition but which lose the capacity when reacted with a silver halide, as described in U.S. Pat. No. 4,503,137. Examples of these compounds include compounds capable of releasing a diffusive dye by intramolecular nucleophilic substitution reaction, as described in U.S. Pat. No. 3,980,479; and compounds capable of releasing a diffusive dye by intramolecular rearrangement reaction of the isoxazolone ring in the molecule, as described in U.S. Pat. No. 4,199,354.

(3) Non-diffusive compounds capable of reacting with a reducing agent, which remains without being oxidized by development, to release a diffusive dye, as described in U.S. Pat. No. 4,559,290, European Patent 220,746A2, U.S. Pat. No. 4,783,396, and Disclosure Bulletin 87-6199.

Examples of such compounds, there are mentioned compounds capable of releasing a diffusive dye by intramolecular nucleophilic substitution reaction after reduction, as described in U.S. Pat. No. 4,139,389 and 4,139,379 and JP-A 59-185333 and 57-84453; compounds capable of releasing a diffusive dye by intramolecular electron-migrating reaction after reduction, as described in U.S. Pat. No. 4,232,107, JP-A 59-101649 and 61-88257 and RD No. 24025 (1984); compounds capable of releasing a diffusive dye by cleavage of the single bond after reduction, as described in German Patent 3,008,588A, JP-A 56-142530 and U.S. Pat. Nos. 4,343,893 and 4,619,884; nitro compounds capable of releasing a diffusive dye after electron reception, as described in U.S. Pat. No. 4,450,223; and compounds of releasing a diffusive dye after electron reception, as described in U.S. Pat. No. 4,609,610.

More preferable compounds are those having an N-X bond (where X means an oxygen, sulfur or nitrogen atom) and an electron-attracting group in one molecule, as described in European Patent 220,746A2, Disclosure Bulletin 87-6199, U.S. Pat. No. 4,783,396, and JP-A 63- 201653 and 63-201654; compounds having $SO_2$-X (where X has the same meaning as mentioned above) and an electron-attracting group in one molecule, as described in JP-A 1- 26842; compounds having a PO-X bond (where X has the same meaning as mentioned above) and an electron-attracting group in one molecule, as described in JP-A 63-271344; and compounds having a C-X' bond (where X' has the same meaning as mentioned above or means —$SO_2$—) and an electron-attracting group in one molecule, as described in JP-A 63-271341. In addition, compounds capable of releasing a diffusive dye by cleavage of the single bond in the molecule after reduction due to the π-bond of conjugating with an electron-receiving group are also usable, as described in JP-A 1-161237 and 1-161342.

More, especially preferred compounds are those having an N-X bond and an electron-attracting group in one molecule. Specific examples of such compounds include Compounds (1) to (3), (7) to (10), (12), (13), (15), (23) to (26), (31), (32), (35), (36), (40), (41), (44), (53) to (59), (64) and (70) described in European Patent 220,746A2, and Compounds (11) to (23) described in Disclosure Bulletin 87-6199.

(4) Compounds (DDR couplers) which have a diffusive dye as the releasing group and release the diffusive dye by reaction with an oxidation product of a reducing agent are also used. Examples of such compounds are described in British Patent 1,330,524, JP-B 48-39165 and U.S. Pat. Nos. 3,443,940, 4,474,877 and 4,483,914.

(5) Compounds (DRR compounds) which can reduce silver halides and organic silver salts and which release a diffusive dye after reducing the halides or salts can also be used. Since the compounds of this type may function even in the absence of any other reducing agent, they are advantageously free from the problem of image stain by the oxidized and decomposed product of a reducing agent. Specific examples of the compounds are described in U.S. Pat. Nos. 3,928,312, 4,053,312, 4,055,428 and 4,336,322, JP-A 59-65839, 59-69839, 53-3819 and 51-104343, RD No. 17465, U.S. Pat. Nos. 3,725,062, 3,728,113 and 3,443,939, JP-A 58-116537 and 57-179840 and U.S. Pat. No. 4,500,626. Preferred examples of such DRR compounds include compounds described in the above-mentioned U.S. Pat. No. 4,500,626, columns 22 to 44. Also, Compounds (1) to (3), (10) to (13), (16) to (19), (28) to (30), (33) to (35), (38) to (40) and (42) to (64) described in U.S. Pat. No. 4,500,626 are preferred. In addition, compounds described in U.S. Pat. No. 4,639,408, columns 37 to 39 are also useful.

The compounds which belong to (3) or (5) are preferred.

Dye donor compounds other than the above-mentioned couplers and the compounds of the formula (LI) include dye-silver compounds comprising an organic silver salt and a dye bonded to each other (RD of May 1978, pages 54 to 58), azo dyes employable in a heat-developing silver dye bleaching method (U.S. Pat. No. 4,235,957, RD of April 1976, pages 30 to 32) and leuco dyes (U.S. Pat. Nos. 3,985,565 and 4,022,617).

The dye donor compound, filter dye, water-insoluble dye, non-diffusive reducing agent and other hydrophobic additives are incorporated into the layers of the photographic material by any known method, for example, by the method described in U.S. Pat. No. 2,322,027. In this case, high boiling point organic solvents such as those described in JP-A 59-83154, 59-178451, 59-178452, 59-178453, 59-178454, 59-178455 and 59-178457 can be used optionally together with low boiling point organic solvents having a boiling point of from 50° C. to 160° C.

The amount of high boiling point organic solvent which can be used in the case is 10 g or less, preferably 5 g or less, per gram of the dye donor compound used. It is suitably one cc or less, more suitably 0.5 cc or less, especially suitably 0.3 cc or less, per gram of the binder.

In addition, a dispersion method with a polymer, as described in JP-B 51-39853 and JP-A 51-59943, may also be employed.

Where the compound to be incorporated into the layers is substantially insoluble in water, it may be dispersed in the binder in the form of fine grains, apart from the above-mentioned methods.

Where the hydrophobic compound is dispersed in a hydrophilic colloid, various surfactants may be used. For instance, surfactants mentioned in JP-A 59-157636, pages 37 to 38, may be used.

The photographic material of the present invention can contain a compound capable of activating the developability and stabilizing the image formed. Examples of such compounds which can preferably be employed in the present invention are described in U.S. Pat. No. 4,500,626, columns 51 to 52.

In the system of forming an image by diffusion and transfer of the dye formed in the present invention, a dye-fixing material is employed together with the light-sensitive photographic material. The system may be classified into two major categories, a format in which the light-sensitive material and the dye-fixing material are separately disposed on two independent supports and a format in which the two materials are provided as coating layers on the same support. With regard to the relationship between the light-sensitive photographic material and the dye-fixing material and the relationship to the support and the relationship to the white reflective layer, those described in U.S. Pat. No. 4,500,626, column 57 are applicable to the present invention.

The dye-fixing material which is preferably used in the present invention has at least one layer containing a mordant agent and a binder. Any known mordant agent can be employed, and specific examples include mordant compounds described in U.S. Pat. No. 4,500,626, columns 58 and 59; JP-A 61-88256, pages 32 to 41; JP-A 62-244043; and JP-A 62-244036. In addition, dye-receiving high polymer compounds, for example, those described in U.S. Pat. No. 4,463,079 can also be employed.

The dye-fixing material may optionally have, if desired, auxiliary layers such as a protective layer, a peeling layer and a curling preventing layer. In particular, provision of a protective layer is helpful.

The binder used in the layer(s) of the photographic material and the dye-fixing material of the present invention is preferably hydrophilic. Examples of hydrophilic binders include those mentioned in JP-A 62- 253159 (pages 26 to 28). Transparent or semi-transparent hydrophilic binders are preferred, which include natural compounds, for example, proteins such as gelatin and gelatin derivatives, polysaccharides such as cellulose derivatives, starch, gum arabic, dextran and pullulan, and other synthetic high polymer compounds. In addition, highly water-absorbing polymers described in JP-A 62- 245260, such as homopolymers of vinyl monomers having —COOM or —$SO_3M$ groups (where M is a hydrogen atom or an alkali metal), or copolymers of these vinyl monomers or copolymers of these vinyl monomers along with other vinyl monomers (e.g., sodium methacrylate, ammonium methacrylate, Sumikagel L-5H produced by Sumitomo Chemical Co.) may also be used. These binders may be used in a combination of two or more.

Where a system of heat-developing a photographic material and applying a slight amount of water is employed in carrying out the present invention, the photographic material of the present invention preferably contains the high water-absorbing polymer so that absorption of water may be effected rapidly. It is also preferred to incorporate the high water-absorbing polymer into the dye-fixing layer and the protective layer so that re-transfer of the once transferred dye to any other material from the dye-fixing material may be prevented.

In accordance with the present invention, the amount of the binder to be coated is preferably 20 g or less, more preferably 10 g or less, and even more preferably 7 g or less, per $m^2$.

The layers constituting the light-sensitive photographic material and dye-fixing material can contain a hardening agent. Examples include hardening agents described in U.S. Pat. No. 4,678,739 (column 41) and JP-A 59-116655, 62-245261 and 61-18942. Specifically, examples include aldehyde hardening agents (e.g., formaldehyde), aziridine hardening agents, epoxy hardening agents (e.g.,

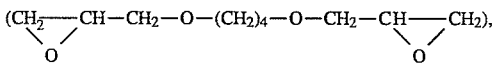

vinylsulfone hardening agents (e.g., N,N'-ethylene-bis(vinylsulfonylacetamino)ethane), N-methylol hardening agents (e.g., dimethylolurea) and high polymer hardening agents (e.g., compounds described in JP-A 62-234157).

In accordance with the present invention, the light-sensitive photographic material and/or the dye fixing material can contain an image formation accelerator. The image formation accelerators include those which promote the redox reaction between a silver salt oxidizing agent and a reducing agent, those which promote the reactions of forming a dye from a dye donor substance or decomposing a dye or releasing a diffusive dye, and those which promote the migration of a dye from the photosensitive layer to the dye-fixing layer. Classified by physicochemical function, the image formation accelerators can be classified into bases or base precursors, nucleophilic compounds, high boiling point organic solvents (oils), thermal solvents, and surfactants and compounds which interact with silver or silver ions, for instance. However, each of these substances generally has plural functions and provides several of the above-mentioned effects. A detailed discussion on these substances can be found in U.S. Pat. No. 4,678,739, columns 38 to 40.

Examples of a base precursor which can be used in the present invention include salts of an organic acid which may be decarboxylated under heat and the use of a base, as well as compounds capable of releasing an amine by intramolecular nucleophilic substitution reaction, Rossen rearrangement or Beckmann rearrangement. Specific examples are described in U.S. Pat. No. 4,511,493 and JP-A 62-65038.

In the system where heat-development and dye transfer are effected simultaneously in the presence of a small amount of water, it is preferred to incorporate the base and/or base precursor in the dye-fixing material for the purpose of improving the storage stability of the light-sensitive photographic material.

In addition, a combination of a metal compound which is hardly soluble and a compound capable of complexing with the metal ion which constitutes the metal compound (hereinafter referred to as a "complex-forming compound") as described in European Patent Application Laid-Open No. 210,660 and U.S. Pat. No. 4,740,445, as well as compounds capable of producing a base by electrolysis as described in JP-A 61-232451 can also be used as the base precursor. Use of the former is especially effective. The metal compound and the complex-forming compound advantageously are separately added to different light-sensitive photographic material and dye-fixing material.

The light-sensitive photographic material and/or the dye-fixing material of the present invention can contain various development terminating agents in order to always obtaining constant images despite of fluctuation of the development temperature and the processing time in development.

The terminology "development terminating agent" as used herein means a compound which, after proper development, quickly neutralizes a base or reacts with a base to lower the base concentration in the layer and thereby terminates the development, or a compound which interacts with silver and a silver salt to arrest development. Specific examples include acid precursors which release an acid under heat, electrophilic compounds which react with the existing base by substitution reaction under heat, as well as nitrogen-containing heterocyclic compounds, mercapto compounds and precursors thereof. More precisely, specific examples of these compounds are described in JP-A 62-253159 (pages 31 to 32).

Layers (including the backing layer) constituting the light-sensitive photographic material or the dye-fixing material may contain various polymer latexes for the purpose of improving the film properties of the material, for example, to elevate the dimension stability of the material and for prevent curling, surface blocking, cracking and formation of pressure marks due to the decrease or increase of sensitivity under pressure. Examples of these polymer latexes include those described in JP-A 62-245258, 62-136648 and 62-110066. In particular, a polymer latex having a low glass transition point (40° C. or lower) is preferably incorporated into a mordant layer so as to effectively prevent surface cracking of the material. A polymer latex having a high glass transition point is preferably incorporated into a backing layer to effectively prevent curling.

The layers constituting the light-sensitive photographic material and dye-fixing material can contain a high boiling point organic solvent as a plasticizer, sliding agent or agent capable of improving the problem of peeling of the photographic material and the dye-fixing material from each other. Examples include compounds described in JP-A 62-253159, page 25, and 62-245253.

In addition, for the above purpose, various kinds of silicone oils (including dimethylsilicone oil and modified silicone oils formed by introducing various organic groups into dimethylsiloxane) can also be used. Examples of these silicone oils include various modified silicone oils described in *Technical Reference of Modified Silicone Oils* (published by Shin-Etsu Silicone Co.), pages 6–18B. Carboxy-modified silicone oil (trade name: X-22- 3710) is particularly effective.

Further, silicone oils described in JP-A 62-215953 and 63-46449 are also useful.

The light-sensitive photographic material and the dye-fixing material can contain an anti-fading agent. Examples of the anti-fading agent include an antioxidant, an ultraviolet absorbent as well as various kinds of metal complexes.

Examples of the antioxidant include chroman compounds, coumaran compounds, phenol compounds (e.g., hindered phenols ) , hydroquinone derivatives, hindered amine derivatives and spiroindane compounds. Compounds described in JP-A 61-159644 are also effective.

Examples of the ultraviolet absorbent include benzotriazole compounds (U.S. Pat. No. 3,533,794), 4-thiazolidone compounds (U.S. Pat. No. 3,352,681) , benzophenone compounds (JP-A 46-2784) and other compounds described in JP-A 54-48535, 62-136641 and 61-88256. Further, ultraviolet-absorbing polymers described in JP-A 62-260152 are also effective.

Examples of the metal complexes include compounds described in U.S. Pat. Nos. 4,241,155, 4,245,018 (columns 3 to 36) and U.S. Pat. No. 4,254,195 (columns 3 to 8), JP-A 62-174741 and 61-88256 (pages 27 to 29), 63-199248, 1-75568 and 1-74272.

Examples of useful anti-fading agents are described in JP-A 62-215272 (pages 125 to 137).

The anti-fading agent for preventing the dye as transferred to the dye-fixing material from fading may previously be incorporated into the dye-fixing material or, alternatively, it maybe supplied to the dye-fixing material from an external source of a light-sensitive photographic material containing the agent.

The above-mentioned antioxidant, ultraviolet absorbent and metal complex can be employed in the present invention in combination.

The light-sensitive photographic material and the dye-fixing material can contain a brightening agent. In particular, it is preferred to incorporate a brightening agent in the dye-fixing material or to supply the brightening agent to the material from an external source of a light-sensitive photographic material containing the brightening agent. Examples of the brightening agent include compounds described in K. Veenkataraman, *The Chemistry of Synthetic Dyes,* Vol. V, Chap. 8, and JP-A 61- 143752. Specific examples include stilbene compounds, coumarin compounds, biphenyl compounds, benzoxazolyl compounds, naphthalimide compounds, pyrazoline compounds and carbostyryl compounds.

The brightening agent can be employed in combination with the anti-fading agent.

The layers constituting the light-sensitive photographic material and dye-fixing material can contain various surfactants for various purposes include coating aid, improvement of peeling property, improvement of slide property, prevention of static charges and enhancement of developability. Specific examples of such surfactants are described in JP-A 62-173463 and JP-A 62-183457.

The layers constituting the light-sensitive photographic material and dye-fixing material can contain organic fluorine compounds for the purpose of improving slide property, preventing of static charges and improving peeling property. Specific examples of such organic fluorine compounds include fluorine surfactants described in JP-B 57-9053 (columns 8 to 17) and JP-A 61-20944 and 62-135826, as well as hydrophobic fluorine compounds such as fluorine oils and similar oily fluorine compounds and ethylene tetrafluoride resins and similar solid fluorine compound resins.

The light-sensitive photographic material and dye-fixing material can contain a mat agent. Examples of the mat agent include silicone dioxide and compounds described in JP-A 61-88256 (page 29) such as polyolefins or polymethacrylates, as well as compounds described in JP-A 63-274944 and 63-274952 such as benzoguanamine resin beads, polycarbonate resin beads and AS resin beads.

In addition, the layers constituting the light-sensitive photographic material and dye-fixing material may further contain a thermal solvent, a defoaming agent, a microbicidal and fungicidal agent, a colloidal silica and other additives. Examples of such additives are described in JP-A 61-88256 (pages 26 to 32).

The support employable in preparing the light-sensitive photographic material and dye-fixing material of the present invention may be any support that withstands the processing temperature. In general, paper and synthetic high polymer films are used as the support. Specifically, the support includes films of polyethylene terephthalate, polycarbonates, polyvinyl chloride, polystyrene, polypropylene, polyimide, celluloses (e.g., triacetyl cellulose) and those films containing a pigment such as titanium oxide; synthetic paper made of polypropylene by filming method; mixed paper made of a synthetic resin pulp (e.g., polyethylene) and a natural pulp; as well as Yankee paper, baryta paper, coated paper (especially cast-coated paper), metals, clothes and glass.

These supports may be used directly as they are or may be coated with a synthetic high polymer substance (e.g., polyethylene) on one surface or both surfaces.

In addition, supports described in JP-A 62-253159, pages 29 to 31 can also be employed in the present invention.

The surface of the support may be coated with a hydrophilic binder and a semiconductive metal oxide (e.g., alumina sol or tin oxide) or an antistatic agent such as carbon black.

The light source to be used for exposure of the color photographic material of the present invention may be a light emission diode or a semiconductor laser. Examples of usable light emission diodes include GaAsP (red), GaP (red, green), GaAsP:N (red, yellow), GaAs (infrared), GaAlAs (infrared, red), GaP:N (red, green, yellow), GaAsSi (infrared), GaN (blue), and SiC (blue).

An infrared-visible conversion element capable of converting the infrared ray as emitted from an infrared emission diode into a visible ray with a fluorescent substance may also be used. Preferred fluorescent substances which can be used for this purpose include rare earth-activated fluorescent substances. Rare earth elements which can be used for this purpose, include $Er^{3+}$, $Tm^{3+}$ and $Yb^{3+}$. Examples of semiconductor lasers used in the present invention include lasers derived from semiconductor materials of $In_{1-x}Ga_xP$ (up to 700 nm), $GaAs_{1-x}P_x$ (610 to 900 nm), $Ga_{1-x}Al_xAs$ (690 to 900 nm), InGaAsP (1100 to 1670 nm), and AlGaAsSb (1250 to 1400 nm). To expose the color photographic material of the present invention with light, YAG laser (1064 nm) derived by exciting Nd:YAG crystals with a light emission diode of $GaAs_xP_{1-x}$ may also be used in addition to the above-mentioned semiconductor lasers.

Also applicable to the color photographic material of the present invention is a secondary higher harmonics generating element (SHG element), which may convert the wavelength of a laser ray to ½ by utilizing the non-linear optical effect thereof. For instance, examples include CD*A and KD*P as non-linear optical crystals usable in the system (refer to *Laser Handbook,* edited by Laser Association, published on Dec. 15, 1982, pages 122 to 139). In addition, an $LiNbO_3$ photoconductive wave guide element in which H+ ion-exchanged photoconductive wave guide is formed in $LiNbO_3$crystals may also be used (refer to Nikkei Electronics, published on Jul. 14, 1986, No. 399, pages 89 to 90).

As mentioned above, a light emission diode and a semiconductor laser are used as a light source for exposing the color photographic material of the present invention.

Other light sources also usable in the present invention include a natural light, a tungsten lamp and a CRT light source.

For imagewise exposing and recording the photographic material of the present invention, various methods can be employed, which include, for example, a method of directly photographing a scene or portrait with a camera; a method of exposing an image through a reversal film or negative film by the use of a printer or an enlarger; a method of scanning and exposing an original through a slit by the use of an exposing device of a duplicator; a method of exposing an image information via the corresponding electric signal by emitting the same with an emitting diode or various lasers; and a method of outputting image information with an image display device such as CRT, liquid crystal display, electroluminescence display or plasma display and then exposing the same directly or through an optical system.

Examples of the light source to be used for recording an image on the photographic material include those described in U.S. Pat. No. 4,500,626 (column 56), such as natural light, tungsten lamp, light-emitting diode, laser rays and CRT rays can be employed, as mentioned above.

Examples of the image information applicable to the photographic material of the present invention include anyone of image signals obtained from a video camera or electronic still camera, television signals as standardized by Nippon Television Signal Standard Commission (NTSC), image signals obtained by dividing an original into plural pixels with a scanner, and image signals formed by the use of a computer such as CG or CAD, can be employed.

Where the heat-developable photographic material of the present invention is processed under heat, the heating temperature in the heat-development step may be from about 50° C. to about 250° C. Preferably, the temperature is from about 80° C. to about 180° C. The step of diffusing and transferring the dye formed by the development may be effected simultaneously with the heat-development step or afterwards. In the latter case, the heating temperature in the transfer step may range from the temperature in the previous heat-development step to room temperature. Preferably, it is from 50° C. to a temperature lower than the temperature in the heat-development step by about 10° C.

The light-sensitive photographic material and/or the dye-fixing material may have an electroconductive heating element layer as a means for heat development and for diffusion and transfer of the formed dyes under heat. In this case, the heating element may be either transparent or opaque, and elements described in JP-A 61- 145544 can be employed. The electroconductive layer acts also as an antistatic layer.

In the heat-developable color photographic material of the present invention, the total thickness of all the layers to be coated on the side of the support, which the silver halide emulsion is provided on, is preferably 15 μm or less as a dry thickness. In this thickness range, transfer of the dye formed may be accelerated so that an image having excellent sharpness can be obtained. Previously, photographic material, however, the problem of poor color separability would often occur. However the present invention is free from the problem.

For accelerating migration of the dye formed, a solvent may be used in the present invention.

Further, as described in detail in JP-A 59-218443 and 61-238056, a method where development and transfer are carried out in the presence of a small amount of a solvent (especially, water) under heat, either at the same time or in a continuous sequence, can be advantageously utilized in processing the heat-developable photographic material of the present invention. In this method, the heating temperature is preferably not lower than 50° C. and not higher than the boiling point of the solvent used. For instance, where the solvent is water, the temperature is desirably from 50° C. to 100° C.

Examples of the solvents used for acceleration of development and/or migration of the diffusive dye formed to the dye-fixing material include water and an aqueous basic solution containing an inorganic alkali metal salt or an organic base. Examples of the bases include those mentioned above for the image formation accelerators. In addition, a low boiling point solvent or a mixed solvent comprising a low boiling point solvent and water or an aqueous basic solution can also be used. Further, surfactants, antifoggants as well as metals which are hardly soluble and complex-forming compounds can be incorporated into the solvents.

The solvent can be used by applying it to either the dye-fixing material or the light-sensitive photographic material or to both. The amount used may be a small amount which is less than the weight of the solvent corresponding to the maximum swollen volume of the total coated layers (especially less than the amount obtained by subtracting the weight of the total coated layers form the weight of the solvent corresponding to the maximum swollen volume of the total coated layers).

Examples of the method of applying the solvent to the light-sensitive layer or the dye-fixing layer include, for example, a method described in JP-A 61-147244 (page 26). In addition, the solvent can be incorporated into either the light-sensitive photographic material or the dye-fixing material or into both of them in the form of solvent-containing microcapsules.

In order to accelerate migration of the dye formed, a system of incorporating a hydrophilic thermal solvent which is solid at room temperature but may melt at a high temperature into a light-sensitive photographic material or into a dye-fixing material may also be employed in the present invention. In this system, the hydrophilic thermal solvent may be incorporated into either the light-sensitive photographic material or the dye-fixing material or into both. The layer to which the solvent is added may be any of the emulsion layer, interlayer, protective layer and dye-fixing layer, but the solvent is preferably added to the dye-fixing layer and/or the adjacent layer(s).

Examples of the thermal solvent to be employed in the system include ureas, pyridines, amides, sulfonamides, imides, alcohols, oximes and other heterocyclic compounds. Also for accelerating migration of the dye formed, a high boiling point organic solvent may be incorporated into the light-sensitive photographic material and/or the dye-fixing material.

For heating the material in the development step and/or the transfer step, the material may be contacted with a heated block or plate, or with a hot plate, hot presser, hot roller, halogen lamp heater or infrared or far-infrared lamp heater or may be passed through a high temperature atmosphere. If desired, an electric heating element layer may be provided in the photographic material or in the dye fixing material, with which the material may be electrically heated. An electric heating element, as described in JP-A 61-145544, may be used.

Where the light-sensitive photographic material is attached to the dye-fixing material and combined together under pressure, a method as described in JP-A 61-147244 (page 27) is applicable to the present invention with respect to the pressure condition and the means of pressing the combined material and element.

For processing the photographic material of the present invention, various known developing apparatus can be utilized. For instance, for processing the heat-developable photographic material of the present invention, apparatus described in JP-A 59-75147, 59- 177547, 59-181353 and 60-18951 and Japanese Utility Model Application Laid-Open No. 62-25944 are preferably employed.

The present invention will be explained in more detail with reference to the following examples, which, however, are- not intended to restrict the scope of the present invention.

EXAMPLE 1

Silver halide emulsion (I) for the third layer and the first layer was prepared as set forth below.

600 ml of an aqueous solution containing sodium chloride and potassium bromide and an aqueous solution of silver nitrate (prepared by dissolving 0.59 mol of silver nitrate in 600 ml of water) were simultaneously added to a well stirred aqueous gelatin solution (containing 20 g of gelatin and 3 g of sodium chloride in 1000 ml of water and kept at 75° C.), at the same flow rate over a period of 40 minutes. Accordingly, a monodispersed cubic silver chlorobromide emulsion (bromide content: 50 mol %) having a mean grain size of 0.40 μm was prepared.

After rinsing with water and desalting, 5 mg of sodium thiosulfate and 20 mg of 4-hydroxy-6-methyl- 1,3,3a,7-tetrazaindene were added thereto and subjected to chemical ripening at 60° C. The yield of the emulsion thus formed was 600 g.

Silver halide emulsion (II) for the fifth layer was prepared as mentioned below.

600 ml of an aqueous solution containing sodium chloride and potassium bromide and an aqueous solution of silver nitrate (prepared by dissolving 0.59 mol of silver nitrate in 600 ml of water) were simultaneously added to a well stirred aqueous gelatin solution (containing 20 g of gelatin and 3 g of sodium chloride in 1000 ml of water and kept at 75° C.), at the same flow rate over a period of 40 minutes. Accordingly, a monodispersed cubic silver chlorobromide emulsion (bromide content: 80 mol %) having a mean grain size of 0.35 μm was prepared.

After rinsing with water and desalting, 5 mg of sodium thiosulfate and 20 mg of 4-hydroxy-6-methyl- 1,3,3a,7-tetrazaindene were added thereto and subjected to chemical ripening at 60° C. The yield of the emulsion thus formed was 600 g.

Gelatin dispersions each containing a dye donor substance were prepared as mentioned below.

15 g of yellow dye donor compound (1), 0.3 g of auxiliary developing agent (5), 0.15 g of anti-foggant (6), 1.5 g of surfactant (18) (sodium dodecylbenzenesulfonate), and 7.5 g of high boiling point organic solvent (17) were weighed. 40 ml of ethyl acetate were added; the mixture was then dissolved under heat at about 60° C. to form a uniform solution. The resulting solution was blended with 125 g of 8% lime-processed gelatin with stirring, and the resulting blend was homogenized and dispersed in a homogenizer at 10000 rpm for 10 minutes. The resulting dispersion is called an yellow dye donor compound-containing gelatin dispersion.

In the same manner as above, except that magenta dye donor compound (2) was used, the amount of sodium dodecylbenzenesulfonate added was varied to 0.375 g, and 7.5 g of high boiling point organic solvent (20) (tri-n-hexyl phosphate) was used, a magenta dye donor compound-containing gelatin dispersion was prepared.

Also in the same manner as above, except that 10 g of cyan dye donor compound (3) and 5 g of cyan dye donor compound (4) were used, a cyan dye donor compound-containing gelatin dispersion was prepared.

Compounds used above are mentioned below.

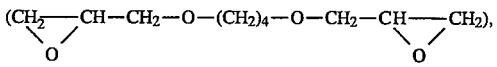

A gelatin dispersion of hydroxide was prepared as mentioned below.

12.55 g of zinc hydroxide having a mean grain size of 0.25 μm, 1 g of carboxymethyl cellulose (as dispersing agent) and 0.1 g of sodium polyacrylate were added to 100 cc of 4% aqueous solution of gelatin and milled in a mill containing glass beads having a mean grain size of 0.75 mm, for 30 minutes. After the glass beads were separated from the milled content, a gelatin dispersion of zinc hydroxide was obtained.

Using the materials as prepared above, a multi-layer heat-developable color photographic material sample 101 having plural layers mentioned below on a support was prepared.

Layer Constitution of Sample 101

Support

Polyethylene-Laminated Paper Support (thickness 130 μm)

| | |
|---|---|
| First Layer: Second Infrared-Sensitive Layer | |
| Gelatin | 510 mg/m$^2$ |
| Light-Sensitive Silver Halide Emulsion (I) | 290 mg/m$^2$ as Ag |
| Sensitizing Dye (13) | 0.04 mg/m$^2$ |
| Anti-Foggant (15) | 0.8 mg/m$^2$ |
| Yellow Dye Donor Compound (1) | 380 mg/m$^2$ |
| High Boiling Point Organic Solvent (17) | 190 mg/m$^2$ |
| Auxiliary Developing Agent (5) | 7.6 mg/m$^2$ |
| Anti-Foggant (6) | 3.8 mg/m$^2$ |
| Surfactant (18) | 38 mg/m$^2$ |
| Water-Soluble Polymer (7) | 20 mg/m$^2$ |
| Second Layer: Interlayer | |
| Gelatin | 640 mg/m$^2$ |
| Zinc oxide | 140 mg/m$^2$ |
| Surfactant (8) | 6 mg/m$^2$ |
| Surfactant (21) | 60 mg/m$^2$ |
| Water-Soluble Polymer (7) | 6 mg/m$^2$ |
| Third Layer: First Infrared-Sensitive Layer | |
| Gelatin | 410 mg/m$^2$ |
| Light-Sensitive Silver Halide Emulsion (I) | 270 mg/m$^2$ as Ag |
| Sensitizing Dye (12) | 0.08 mg/m$^2$ |
| Anti-Foggant (15) | 0.4 mg/m$^2$ |
| Anti-Foggant (16) | 6 mg/m$^2$ |
| Cyan Dye Donor Compound (3) | 200 mg/m$^2$ |
| Cyan Dye Donor Compound (4) | 100 mg/m$^2$ |
| High Boiling Point Organic Solvent (17) | 150 mg/m$^2$ |
| Auxiliary Developing Agent (5) | 6 mg/m$^2$ |
| Anti-Foggant (6) | 3 mg/m$^2$ |
| Surfactant (18) | 30 mg/m$^2$ |
| Water-Soluble Polymer (7) | 10 mg/m$^2$ |
| Fourth Layer: Interlayer | |
| Gelatin | 560 mg/m$^2$ |
| Zinc Hydroxide | 170 mg/m$^2$ |
| Surfactant (8) | 10 mg/m$^2$ |
| Surfactant (19) | 50 mg/m$^2$ |
| Water-Soluble Polymer (7) | 6 mg/m$^2$ |
| Fifth Layer: Red-Sensitive Layer | |
| Gelatin | 270 mg/m$^2$ |
| Light-Sensitive Silver Halide Emulsion (II) | 270 mg/m$^2$ as Ag |
| Sensitizing Dye (11) | 1.7 mg/m$^2$ |
| Anti-Foggant (14) | 4.3 mg/m$^2$ |
| Magenta Dye Donor Compound (2) | 240 mg/m$^2$ |
| High Boiling Point Organic Solvent (20) | 120 mg/m$^2$ |
| Auxiliary Developing Agent (5) | 4.8 mg/m$^2$ |
| Anti-Foggant (6) | 2.4 mg/m$^2$ |
| Surfactant (18) | 6 mg/m$^2$ |
| Water-Soluble Polymer (7) | 10 mg/m$^2$ |
| Sixth Layer: Protective Layer | |
| Gelatin | 1130 mg/m$^2$ |
| Water-Soluble Polymer (7) | 10 mg/m$^2$ |
| Mat Agent (silica) | 40 mg/m$^2$ |

-continued

| | |
|---|---|
| Surfactant (8) | 60 mg/m$^2$ |
| Surfactant (9) | 30 mg/m$^2$ |
| Hardening Agent (10) | 60 mg/m$^2$ |

Compounds used above are mentioned below, except for those already mentioned previously. Hardening agent (10) is 1,2-bis(vinylsulfonylacetamido)ethane.

Dye Fixing Material Sample R-1 was prepared as mentioned below.

The following three layers (first layer to third layer) were coated on one surface of a paper support and the following two backing layers on the other surface of the same to prepare Sample R-1.

Water-Soluble Polymer (7):

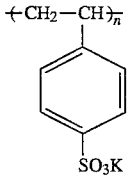

Surfactant (8):

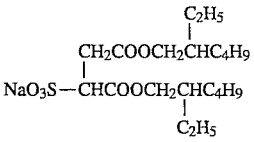

Surfactant (9):

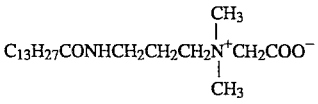

Sensitizing Dye (11):

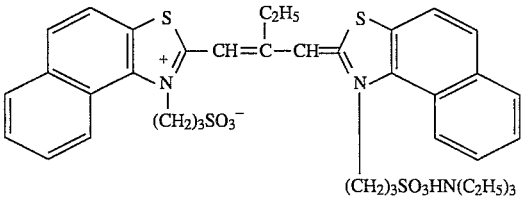

Sensitizing Dye (12):

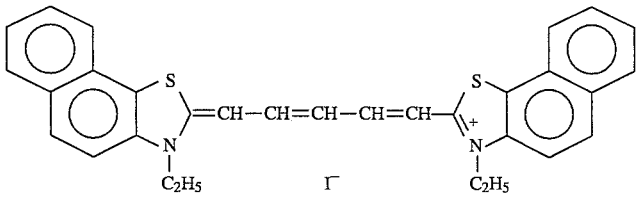

Sensitizing Dye (13):

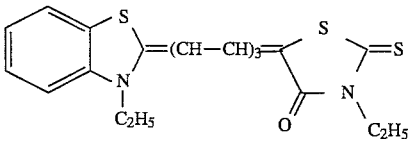

Anti-Foggant (14):

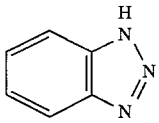

Anti-Foggant (15):

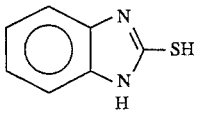

Anti-Foggant (16):

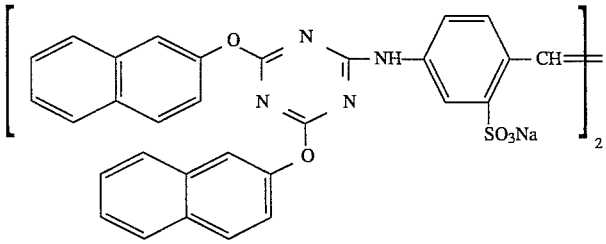

| | |
|---|---|
| First Layer: Subbing Layer | |
| Gelatin | 450 mg/m$^2$ |
| Surfactant (24) | 10 mg/m$^2$ |
| Water-Soluble Polymer (25) | 40 mg/m$^2$ |
| Hardening Agent (31) | 300 mg/m$^2$ |
| Second Layer: Mordant Layer | |
| Gelatin | 1400 mg/m$^2$ |
| Water-Soluble Polymer (25) | 200 mg/m$^2$ |
| Water-Soluble Polymer (26) | 600 mg/m$^2$ |
| Mordant Agent (27) | 2350 mg/m$^2$ |
| High Boiling Point Solvent (28) | 1400 mg/m$^2$ |
| Guanidine Picolinate | 2400 mg/m$^2$ |
| Brightening Agent (29) | 50 mg/m$^2$ |
| Surfactant (8) | 150 mg/m$^2$ |
| Third Layer: Protective Layer | |
| Gelatin | 50 mg/m$^2$ |
| Silicone Oil (22) | 40 mg/m$^2$ |
| Surfactant (8) | 1 mg/m$^2$ |
| Surfactant (23) | 20 mg/m$^2$ |
| Surfactant (24) | 100 mg/m$^2$ |
| Silica (size 4μ) | 20 mg/m$^2$ |
| Guanidine Picolinate | 550 mg/m$^2$ |
| Water-Soluble Polymer (25) | 240 mg/m$^2$ |
| First Backing Layer: | |
| Gelatin | 3250 mg/m$^2$ |
| Hardening Agent (31) | 250 mg/m$^2$ |
| Second Backing Layer: | |
| Gelatin | 440 mg/m$^2$ |
| Silicone Oil (22) | 80 mg/m$^2$ |
| Surfactant (8) | 40 mg/m$^2$ |
| Surfactant (30) | 10 mg/m$^2$ |
| Mat Agent (32) | 30 mg/m$^2$ |

The paper support used is one composed of the following layers:

| | |
|---|---|
| Surface Subbing Layer (thickness 0.1μ): | |
| Gelatin | |
| Surface PE Layer (glossy layer, thickness 45.0μ): | |
| Low-Density Polyethylene (density 0.923) | 89.2 parts |
| Surface-Treated Titanium Oxide | 10.0 parts |
| Ultramarine | 0.8 parts |
| Pulp Layer (thickness 92.6μ): | |
| High-Quality Paper (LBKP/NBKP = 1/1, density 1.080) | |
| Surface PE Layer (mat layer, thickness 36.0μ): | |
| High-Density Polyethylene (density 0.960) | |
| Surface Subbing Layer: | |
| Gelatin (thickness 0.05μ) | |
| Colloidal Silica (thickness 0.05μ) | |
| Total Thickness | 173.8μ |

Compounds used above are mentioned below except those already mentioned previously.

Silicone Oil (22):

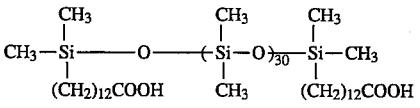

Surfactant (23):

$C_8F_{17}SO_2N(C_3H_7)CH_2COOK$

-continued

Surfactant (24):

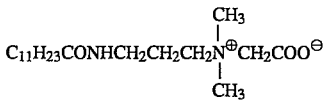

Surfactant (30):

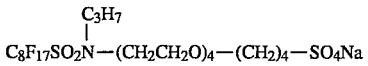

Mordant Agent (27):

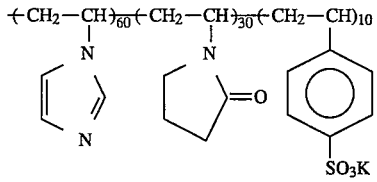

High Boiling Point Solvent (28):

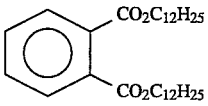

Hardening Agent (31):

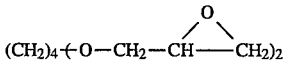

Mat agent, water-soluble polymers and brightening agent used are as follows:

Mat Agent (32):

Benzoguanamine Resin (mean grain size 15 μ)

Water-Soluble Polymer (25):

Sumikagel L5-H (product by Sumitomo Chemical Co.)

Water-Soluble Polymer (26):

Dextran (molecular weigh: 70,000)

Brightening Agent (29):

2,5-Bis(5-tert-butylbenzoazolyl(2))thiophene

Photographic material samples 102 to 109 were prepared in the same manner as in preparation of sample 101, except that infrared filter dye F-1 or F-2 was added as indicated in Table 1 below. A filter dye was added to samples, 102 to 105 in the form of a single emulsified dispersion of only the dye. A single emulsified dispersion of filter dye was prepared as mentioned below. The case of using filter dye F-1 is illustrated below, and the illustration applies to the case of using filter dye F-2.

Preparation of Single Emulsified Dispersion of Only Filter Dye 2.8 g of filter dye (F-1), 1.5 g of sodium dodecylbenzenesulfonate (as surfactant) and 7.5 g of triisononyl phosphate (as surfactant) were weighed, and 40 ml of ethyl acetate was added thereto and dissolved under heat at about 60° C. to form a uniform solution. The resulting solution was blended with 125 g of 8% lime-processed gelatin solution with stirring and then homogenized and dispersed in a homogenizer at 10000 rpm for 10 minutes. The dispersion thus formed is filter dye (F-1)-containing gelatin dispersion.

On the other hand, a filter dye was added to samples 106 to 109 in the form of a co-emulsified dispersion along with a dye donor compound. In this case, a determined amount of a filter dye was added to an emulsion of a dye donor compound during emulsification of the same to obtain an intended co-emulsified dispersion.

Filter dye (F-1) is Compound No. 1 mentioned above; and filter dye (F-2) is Compound No. 31 mentioned above.

TABLE 1

| Sample No. | Filter Dye | Filter Dye-Containin g Layer | Amount of Filter Dye Added (mg/m$^2$) | Emulsification Method |
|---|---|---|---|---|
| 101 (comparative example) | No | — | — | — |
| 102 (comparative example) | F-1 | 2nd layer | 70 | single emulsification |
| 103 (comparative example) | F-2 | 2nd layer | 150 | single emulsification |
| 104 (comparative example) | F-1 | 1st layer | 70 | single emulsification |
| 105 (comparative example) | F-2 | 1st layer | 150 | single emulsification |
| 106 (example of the invention) | F-1 | 1st layer | 70 | co-emulsification |
| 107 (example of the invention) | F-1 | 1st layer | 45 | co-emulsification |
| 108 (example of the invention) | F-2 | 1st layer | 150 | co-emulsification |
| 109 (example of the invention) | F-2 | 1st layer | 100 | co-emulsification |

These samples were exposed in the manner mentioned below and the photographic properties of the samples were then evaluated.

Each sample was exposed to a laser ray, using-the laser exposure apparatus as described in Japanese Patent Application Nos. 63-281418 and 63-204805, under the condition mentioned in Table 2 below. 12 ml/m$^2$ of water were applied to the emulsion surface of each of the exposed samples, by wire bar coating. Then, the sample was attached to dye fixing material sample R-1 with the coated surfaces of the two facing to each other. Using a heat roller, the combined samples were heated so that the water-applied surface of the sample had a temperature of 90° C. for 20 seconds. The photographic material sample was then peeled off from the dye-fixing material sample, whereby an image was formed on the latter.

TABLE 2

| Condition for Laser Exposure | |
|---|---|
| Beam Strength on Sample | 1 mW |
| Scanning Line Density | 100 ± 10 μm in the main scanning direction<br>80 ± 10 μm in the sub-scanning direction |
| Exposure Time | 0.9 msec/luster |
| Laser Ray Wavelength for Exposure | 670 nm (laser ray)<br>750 nm (laser ray)<br>810 nm (laser ray) |
| Exposure Amount | 1 log E variation (for each track) per 2.5 cm in the sub-scanning direction |
| Method of Varying Exposure Amount | Emission Time Modulation |

The maximum density (Dmax) of each track of yellow (Y), cyan (C) and magenta (M), and the yellow density in the cyan Dmax area are shown in Table 3 below. The transferred image of each sample was subjected to sensitometry, whereupon the variation of the sensitivity at the density 1.0 in the yellow characteristic curve was obtained as a difference in the relative value of log E on the basis of the value of sample 101. The results obtained are also shown in Table 3.

TABLE 3

| | Cyan | | Magenta | Yellow | |
|---|---|---|---|---|---|
| Sample No. | C density | Y density | M density | Y density | Y density |
| 101 (comparative example) | 2.30 | 1.28 | 2.23 | 2.01 | ±0 |
| 102 (comparative example) | 2.31 | 0.45 | 2.25 | 2.00 | −0.9 |
| 103 (comparative example) | 2.30 | 0.43 | 2.23 | 2.01 | −0.9 |
| 104 (comparative example) | 2.32 | 0.75 | 2.24 | 2.00 | −0.9 |
| 105 (comparative example) | 2.31 | 0.82 | 2.24 | 2.00 | −0.9 |
| 106 (example of the invention) | 2.31 | 0.43 | 2.25 | 2.00 | −0.6 |
| 107 (example of the invention) | 2.30 | 0.62 | 2.23 | 2.01 | −0.3 |
| 108 (example of the invention) | 2.31 | 0.45 | 2.24 | 2.00 | −0.5 |
| 109 (example of the invention) | 2.31 | 0.63 | 2.23 | 2.01 | −0.3 |

From the data in Table 3 above, it is noted that lowering of the yellow density, which is considered to be caused by the broadened peak of the filter dye as incorporated in each sample, is noticeable in samples 102 to 105 each containing a single dispersion of only the filter dye. In contrast, samples 106 and 108 each containing a co-emulsified dispersion of the filter dye and the dye donor compound had a larger filter effect than samples 104 and 105 each containing a single dispersion of only the filter dye, so that color separation and image discrimination of the samples representative of the present invention were better than the comparative samples. In samples 107 and 109, the amount of the filter dye in the co-emulsified dispersion was lowered, but they still had a better filter effect.

Next, samples 101 to 109 were stored under the temperature conditions of 60° C. and a humidity of 60% for 3 days and thereafter processed in the same manner as above. The yellow density in the area having a maximum cyan density (cyan D max) was measured in every sample, and the results are shown in Table 4 below.

TABLE 4

| Sample No. | Y density in cyan area |
|---|---|
| 101 (comparative example) | 1.28 |
| 102 (comparative example) | 1.05 |
| 103 (comparative example) | 0.74 |
| 104 (comparative example) | 0.97 |
| 105 (comparative example) | 0.99 |

TABLE 4-continued

| Sample No. | Y density in cyan area |
|---|---|
| 106 (example of the invention) | 0.45 |
| 107 (example of the invention) | 0.63 |
| 108 (example of the invention) | 0.47 |
| 109 (example of the invention) | 0.64 |

From the data in Table 4 above, it is seen that the stability of the filter dye in samples 106 to 109 of the present invention is excellent during storage of the raw film.

EXAMPLE 2

A latex of dye trapping agent (49) was prepared as mentioned below.

A mixture comprising 108 cc of a polymer latex mentioned below (solid content 13%), 20 g of surfactant (48) and 1,232 cc of water was stirred at 40° C., and 600 cc of 5% aqueous solution of surfactant (8) was dropwise added thereto over a period of 10 minutes. The resulting dispersion was concentrated to 500 cc with an ultrafiltration module and then desalted, and 1500 cc of water was added thereto. The same process was repeated once again. Thus, a latex of dye trapping agent (49) was obtained.

Compounds used above are mentioned below.

Polymer Latex:

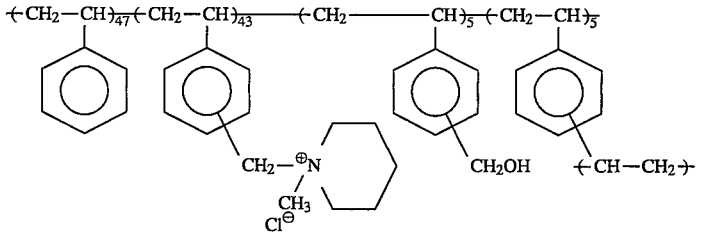

Surfactant (48):

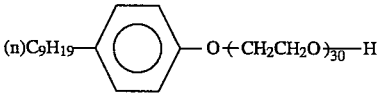

Next, a dispersion of electron transmitting agent (41) was prepared as mentioned below.

10 g of electron transmitting agent (41), mentioned below, 0.5 g of polyethylene glycol nonylphenyl ether (as dispersing agent) and 0.5 g of anionic surfactant (8) were added to 5% aqueous gelatin solution and milled with glass beads having a mean grain size of 0.75 mm for 60 minutes. After the glass beads were separated, a electron transmitting agent-containing dispersion having a mean grain size of 0.3 μ was obtained.

Electron Transmitting Agent (41):

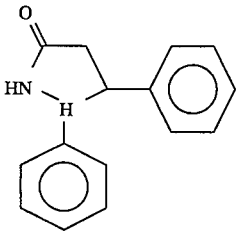

Next, a gelatin dispersion of hydrophobic additives was prepared as mentioned below.

The oil phase components mentioned in Table 5 below were dissolved in 50 cc of ethyl acetate to form a uniform solution having a temperature of 60° C. The aqueous phase components (also mentioned in the same Table 5) already heated up to 60° C. were then added; and the mixture was dispersed in a disperser with a dissolver having a diameter of 8 cm, at 5,000 rpm for 30 minutes. Water was further added thereto and stirred to form a uniform dispersion. This is called a hydrophobic additive-containing gelatin dispersion.

TABLE 5

| | | Cyan | Magenta | Yellow | Reducing Agent |
|---|---|---|---|---|---|
| Oily Phase | Dye Donor Compound (33) | — | — | 39 | — |
| | Dye Donor Compound (34) | — | 46.5 | — | — |
| | Dye Donor Compound (35) | 33.9 | — | — | — |
| | Dye Donor Compound (36) | 11.6 | — | — | — |
| | Reducing Agent (37) | 16 | 16.8 | 19.4 | — |

TABLE 5-continued

| | | Cyan | Magenta | Yellow | Reducing Agent |
|---|---|---|---|---|---|
| | Reducing Agent (39) | — | — | — | 60 |
| | Reducing Agent (40) | — | — | — | 17.6 |
| | Electron Transmitting Agent Precursor (38) | 4.3 | 4.3 | 2.6 | — |
| | Nucleating Agent (42) | — | — | — | 5.5 |
| | High Boiling Point Solvent (43) | 18.2 | 18.6 | 15.6 | 25.5 |
| | High Boiling Point Solvent (44) | — | — | 11.7 | — |
| | Anti-Foggant (45) | 1.2 | 1.3 | 0.8 | — |
| Aqueous Phase | Lime-Processed Gelatin | 30 | 30 | 30 | 50 |
| | Surfactant (18) | 4.5 | 4.5 | 4.5 | 2.3 |
| | Water | 266 | 266 | 266 | 450 |
| | Citric Acid | — | — | 0.6 | — |
| | Water (supplemented) | 600 | 650 | 700 | 550 |

Compounds used above are mentioned below.

Yellow Dye Donor Compound (33):

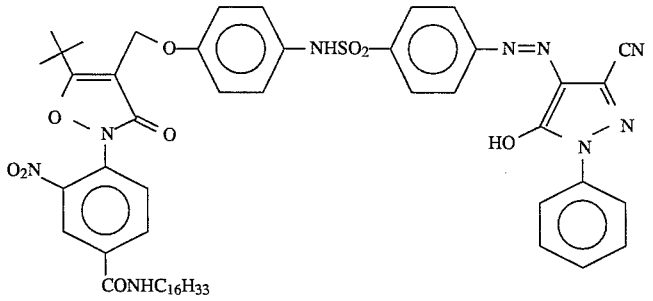

Magenta Dye Donor Compound (34):

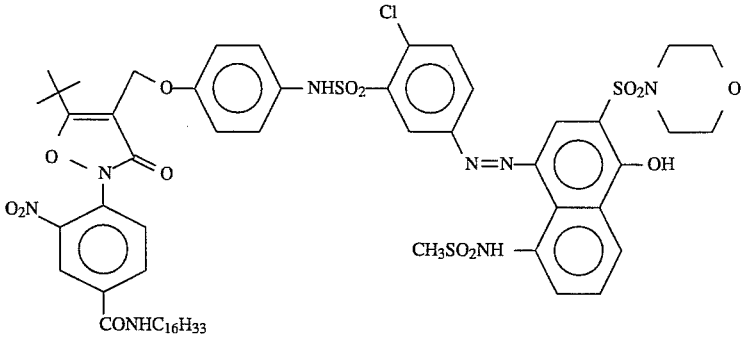

Cyan Dye Donor Compound (35):

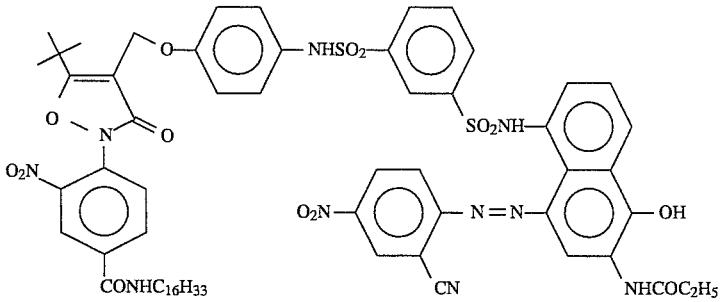

-continued

Cyan Dye Donor Compound (36):

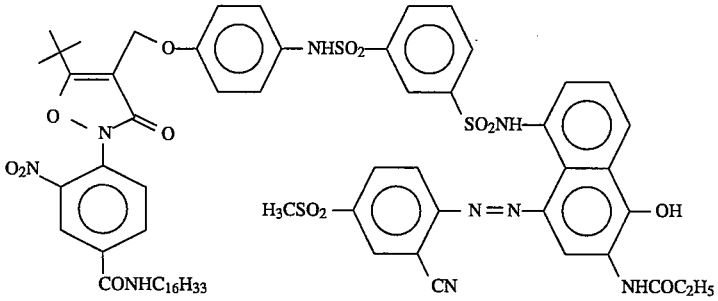

Reducing Agent (37)

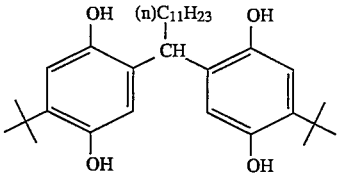

Reducing Agent (39):

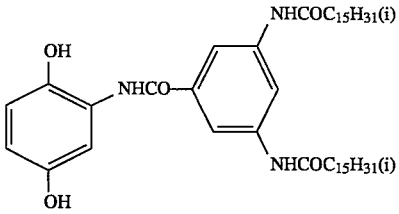

Reducing Agent (40):

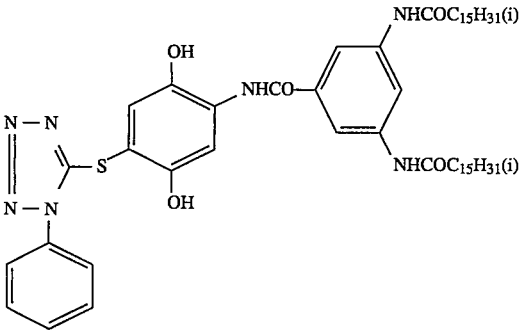

Electron Transmitting Agent Precursor (38):

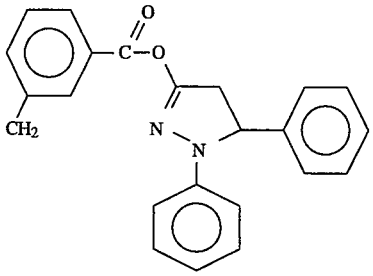

Nucleating Agent (42):

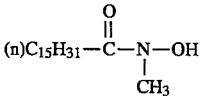

High Boiling Point Solvent (43):

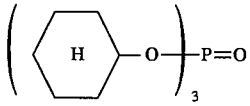

High Boiling Point Solvent (44):

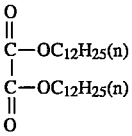

Anti-Foggant (45):

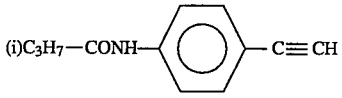

Using the materials as prepared above, a multi-layer heat-developable color photographic material sample 201 having plural layers mentioned below on a support was prepared.

Layer Constitution of Sample 201

Support

Polyethylene-laminated Paper Support (thickness 130 μm)

| First Layer: Second Infrared-Sensitive Layer: | |
|---|---|
| Gelatin | 540 mg/m$^2$ |
| Light-Sensitive Silver Halide Emulsion (I) | 470 mg/m$^2$ as Ag |
| Sensitizing Dye (13) | 0.07 mg/m$^2$ |
| Anti-Foggant (47) | 1.2 mg/m$^2$ |
| Potassium Bromide | 6 mg/m$^2$ |
| Yellow Dye Donor Substance (33) | 400 mg/m$^2$ |
| Reducing Agent (37) | 200 mg/m$^2$ |
| Electron Transmitting Agent Precursor (38) | 26 mg/m$^2$ |
| Anti-Foggant (45) | 8 mg/m$^2$ |
| High Boiling Point Solvent (43) | 160 mg/m$^2$ |
| High Boiling Point Solvent (44) | 120 mg/m$^2$ |

-continued

| | |
|---|---|
| Citric Acid | 6 mg/m$^2$ |
| Surfactant (18) | 50 mg/m$^2$ |
| Water-Soluble Polymer (7) | 13 mg/m$^2$ |
| Second Layer: Interlayer | |
| Gelatin | 690 mg/m$^2$ |
| Zinc Hydroxide | 470 mg/m$^2$ |
| Reducing Agent (39) | 140 mg/m$^2$ |
| Reducing Agent (40) | 40 mg/m$^2$ |
| Nucleating Agent (42) | 15 mg/m$^2$ |
| High Boiling Point Solvent (43) | 60 mg/m$^2$ |
| Dye Trapping Agent (49) | 40 mg/m$^2$ |
| Surfactant (8) | 10 mg/m$^2$ |
| Surfactant (18) | 5 mg/m$^2$ |
| Surfactant (19) | 25 mg/m$^2$ |
| Water-Soluble Polymer (7) | 4 mg/m$^2$ |
| Water-Soluble Polymer (26) | 40 mg/m$^2$ |
| Water-Soluble Polymer (50) | 50 mg/m$^2$ |
| Third Layer: First Infrared-Sensitive Layer | |
| Gelatin | 320 mg/m$^2$ |
| Light-Sensitive Silver Halide Emulsion (I) | 220 mg/m$^2$ as Ag |
| Sensitizing Dye (12) | 0.07 mg/m$^2$ |
| Anti-Foggant (46) | 0.8 mg/m$^2$ |
| Potassium Bromide | 5 mg/m$^2$ |
| Cyan Dye Donor Substance (35) | 230 mg/m$^2$ |
| Cyan Dye Donor Substance (36) | 80 mg/m$^2$ |
| Reducing Agent (37) | 110 mg/m$^2$ |
| Electron Transmitting Agent Precursor (38) | 30 mg/m$^2$ |
| High Boiling Point Solvent (43) | 123 mg/m$^2$ |
| Anti-Foggant (45) | 8 mg/m$^2$ |
| Surfactant (18) | 30 mg/m$^2$ |
| Water-Soluble Polymer (7) | 7 mg/m$^2$ |
| Fourth Layer: Interlayer | |
| Gelatin | 600 mg/m$^2$ |
| Electron Transmitting Agent (41) | 80 mg/m$^2$ |
| Reducing Agent (39) | 140 mg/m$^2$ |
| Reducing Agent (40) | 40 mg/m$^2$ |
| Nucleating Agent (42) | 15 mg/m$^2$ |
| High Boiling Point Solvent (43) | 60 mg/m$^2$ |
| Surfactant (8) | 10 mg/m$^2$ |
| Surfactant (18) | 5 mg/m$^2$ |
| Water-Soluble Polymer (7) | 9 mg/m$^2$ |
| Water-Soluble Polymer (26) | 40 mg/m$^2$ |
| Hardening Agent (10) | 45 mg/m$^2$ |
| Fifth Layer: Red-Sensitive Layer | |
| Gelatin | 370 mg/m$^2$ |
| Light-Sensitive Silver Halide Emulsion (II) | 300 mg/m$^2$ as Ag |
| Sensitizing Dye (11) | 1.9 mg/m$^2$ |
| Anti-Foggant (46) | 1 mg/m$^2$ |
| Potassium Bromide | 7 mg/m$^2$ |
| Magenta Dye Donor Substance (34) | 330 mg/m$^2$ |
| High Boiling Point Solvent (43) | 135 mg/m$^2$ |
| Reducing Agent (37) | 120 mg/m$^2$ |
| Electron Transmitting Agent Precursor (38) | 20 mg/m$^2$ |
| Anti-Foggant (45) | 10 mg/m$^2$ |
| Surfactant (18) | 32 mg/m$^2$ |
| Water-Soluble Polymer (7) | 9 mg/m$^2$ |
| Sixth Layer: Protective Layer | |
| Gelatin | 730 mg/m$^2$ |
| Zinc Hydroxide | 730 mg/m$^2$ |
| Mat Agent (silica) | 40 mg/m$^2$ |
| Surfactant (8) | 20 mg/m$^2$ |
| Surfactant (48) | 100 mg/m$^2$ |
| Water-Soluble Polymer (7) | 2 mg/m$^2$ |
| Water-Soluble Polymer (26) | 30 mg/m$^2$ |

Compounds used above were same as those used in Example 1, except anti-foggants mentioned below.

Anti-Foggant (46):

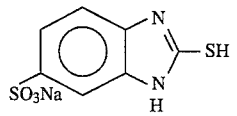

Anti-Foggant (47):

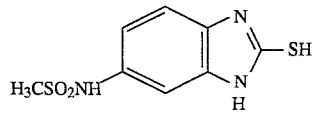

Water-soluble polymer (50) was polyvinyl alcohol having a molecular weight of 2,000.

Other photographic material samples 202 to 206 were prepared in the same manner as in preparation of sample 201, except that filter dye (F-1) (Compound No. 1) was added to each sample in the manner as indicated in Table 6 below. The emulsified dispersion of filter dye (F-1) was prepared in the same manner as in Example 1.

TABLE 6

| Sample No. | Filter Dye | Filter Dye-Containing Layer | Amount of Filter Dye Added (mg/m$^2$) | Emulsification Method |
|---|---|---|---|---|
| 201 (comparative example) | No | — | — | — |
| 202 (comparative example) | F-1 | 2nd layer | 50 | single emulsification |
| 203 (comparative example) | F-1 | 1st layer | 50 | single emulsification |
| 204 (comparative example) | F-1 | 1st layer | 100 | single emulsification |
| 205 (example of the invention) | F-1 | 1st layer | 50 | co-emulsification |
| 206 (example of the invention) | F-1 | 1st layer | 40 | co-emulsification |

Using the same light source as that used in Example 1, each of samples 201 to 206 was subjected to gradation exposure with a laser ray of 750 nm. 15 ml/m$^2$ of water were applied to each of the exposed samples, and the sample was attached to dye fixing material sample R-1 and heat-developed in the same manner as in Example 1, at 85° C. for 15 seconds. The cyan density and yellow density in the high-exposure area of the processed sample were measured and shown in Table 7 below. The cyan density and yellow density in the non-exposed area were about 2.10 and about 2.00, respectively, in every sample.

TABLE 7

| Sample No. | Cyan Density | Yellow Density |
|---|---|---|
| 201 (comparative example) | 0.19 | 0.73 |
| 202 (comparative example) | 0.19 | 1.35 |
| 203 (comparative example) | 0.20 | 1.23 |
| 204 (comparative example) | 0.20 | 1.53 |
| 205 (example of the invention) | 0.19 | 1.90 |
| 206 (example of the invention) | 0.20 | 1.81 |

From the data in Table 7 above, it is seen that lowering of the yellow density in the high-exposure area (as exposed with the laser ray of 750 nm) was small in samples 205 and 206 of the present invention.

Next, these samples 201 to 206 were stored under a temperature condition of 45° C. and a humidity of 80% for 3 days and then processed in the same manner as above. As a result, the change in yellow density in the high-exposure area of the comparative samples 201 to 204 was lowered from 0.7 to 0.8; while that in the samples 205 and 206 of the present invention did not change and were almost the same as the yellow density in the non-stored samples. Thus, it is seen that the filter effect of the photographic material samples of the present invention was not lowered and, therefore, the raw film storability is good.

As is mentioned in detail in the above, the color photographic material of the present invention has excellent color separatability and image discriminatability and has excellent raw film storability.

EXAMPLE 3

Emulsions (1) to (3) were prepared as mentioned below.

Precisely, solution I and solution II as mentioned in Table B below were added to a well stirred aqueous solution A (having the composition mentioned in Table A below), at 60° C. over a period of 20 minutes, and then solution III and solution IV also mentioned in Table B were added thereto over a period of 35 minutes. After washing with water and desalting, 25 g of gelatin was added to the resulting emulsion. This was adjusted to have a pH of 6.1 and pAg of 8.0 and then chemical-sensitized at 61° C. Chemical sensitization was optimally effected with triethylthiourea and 4-hydroxy-6-methyl- 1,3,3a,7-tetrazaindene in such a way that the sensitivity peak was obtained by an exposure of $10^{-4}$ second.

The yield, grain size and crystal habit of the emulsions obtained are shown in Table C below. As is obvious therefrom, the emulsions were all monodispersed emulsions.

TABLE A

| Composition of Aqueous Solution A | Emulsion (1) | Emulsion (2) | Emulsion (3) |
|---|---|---|---|
| $H_2O$ | 630 cc | 720 cc | 810 cc |
| Gel | 20 g | 22 g | 19 g |
| KBr | 0.1 g | 10 g | — |
| NaCl | 4 g | 2 g | 6 g |
| KI | — | 0.01 g | — |
| 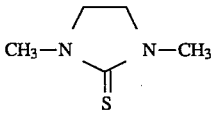 | 0.015 g | — | 0.03 g |

TABLE B

| Solutions I to IV | Emulsion (1) | | | | Emulsion (2) | | | | Emulsion (3) | | | |
|---|---|---|---|---|---|---|---|---|---|---|---|---|
| | I | II | III | IV | I | II | III | IV | I | II | III | IV |
| $AgNO_3$ | 50 g | — | 50 g | — | 30 g | — | 70 g | — | 20 g | — | 80 g | — |
| KBr | — | 21 g | — | 28 g | — | 21 g | — | 47.6 g | — | 13.3 g | — | 36.4 g |
| NaCl | — | 6.9 g | — | 3.5 g | — | — | — | — | — | 0.5 g | — | 9.6 g |
| KI | — | — | — | — | — | 1 g | — | 2 g | — | — | — | — |
| Water to make (cc) | 250 | 250 | 200 | 400 | 300 | 300 | 500 | 600 | 100 | 100 | 400 | 400 |

TABLE C

| | Emulsion (1) | Emulsion (2) | Emulsion (3) |
|---|---|---|---|
| Yield | 610 g | 630 g | 615 g |
| Mean Grain Size | 0.30 μm | 0.38 μm | 0.37 μm |
| Crystal Habit | cubic | octahedral | cubic |

Dye donor substance-containing gelatin dispersions were prepared as mentioned below.

14.5 g of magenta dye donor substance (A), 1.2 g of reducing agent (mentioned below), 0.15 g of mercapto compound (1), 0.4 g of surfactant (3) and 5.1 g of high boiling point organic solvent (2) were weighed, and 70 cc of ethyl acetate were added thereto and dissolved under heat at about 60° C. to form a uniform solution. The solution was blended with 100 g of 10% lime-processed gelatin solution and 60 cc of water by stirring and then homogenized and dispersed in a homogenizer at 10,000 rpm for 10 minutes. The dispersion prepared is called a magenta dye donor substance dispersion.

7.3 g of cyan dye donor substance (B1), 10.6 g of cyan dye donor substance (B2), 1.2 g of reducing agent (mentioned below), 0.3 g of mercapto compound (1), 1.5 g of surfactant (3) and 9.8 g of high boiling point organic solvent (1) were weighed, and 40 cc of ethyl acetate was added thereto and dissolved under heat at about 60° C. to form a uniform solution. The solution was blended with 100 g of 10% lime-processed gelatin solution and 60 cc of water by stirring and then homogenized and dispersed in a homogenizer at 10000 rpm for 10 minutes. The dispersion prepared is called a cyan dye donor substance dispersion.

15 g of yellow dye donor substance (C), 1.2 g of reducing agent (mentioned below), 0.15 g of mercapto compound (1), 1.5 g of surfactant (3) and 7.5 g of high boiling point organic solvent (1) were weighed, and 45 cc of ethyl acetate was added thereto and dissolved under heat at about 60° C. to form a uniform solution. The solution was blended with 100 g of 10% lime-processed gelatin solution and 60 cc of water with stirring and then homogenized and dispersed in a homogenizer at 10,000 rpm for 10 minutes. The dispersion thus prepared is called an yellow dye donor substance dispersion.

Using the materials thus prepared, a heat-developable diffusion transfer color photographic material sample 300 (comparative example) composed of the layers as mentioned below was produced.

Layer Constitution of Sample 300

Support

Polyethylene-Laminated Neutral Paper Support (thickness 120 μm)

| | |
|---|---|
| Anti-Halation Layer: | |
| Carbon Black | 0.44 g/m$^2$ |
| Polyvinyl Chloride | 0.30 g/m$^2$ |
| First Layer: Infrared (810 nm)-Sensitive Layer | |
| Emulsion (3) | 0.28 g/m$^2$ as Ag |
| Mercapto Compound (2) | $7.9 \times 10^{-4}$ g/m$^2$ |
| Sensitizing Dye (3) | $3.5 \times 10^{-5}$ g/m$^2$ |
| Yellow Dye Donor Substance (C) | 0.35 g/m$^2$ |
| High Boiling Point Organic Solvent (1) | 0.18 g/m$^2$ |
| Reducing Agent | 0.028 g/m$^2$ |
| Mercapto Compound (1) | $3.5 \times 10^{-3}$ g/m$^2$ |
| Surfactant (3) | 0.035 g/m$^2$ |
| Gelatin | 0.50 g/m$^2$ |
| Water-Soluble Polymer (1) | 0.019 g/m$^2$ |

-continued

| | |
|---|---|
| Second Layer: Interlayer | |
| Gelatin | 0.63 g/m$^2$ |
| $Zn(OH)_2$ | 0.20 g/m$^2$ |
| Surfactant (1) | $6.17 \times 10^{-3}$ g/m$^2$ |
| Surfactant (4) | 0.057 g/m$^2$ |
| Water-Soluble Polymer (1) | $9.2 \times 10^{-3}$ g/m$^2$ |
| Third Layer: Near Infrared (750 nm)-Sensitive Layer | |
| Emulsion (2) | 0.27 g/m$^2$ as Ag |
| Mercapto Compound (2) | $3.8 \times 10^{-4}$ g/m$^2$ |
| Sensitizing Dye (2) | $1.1 \times 10^{-4}$ g/m$^2$ |
| Cyan Dye Donor Substance ($B_1$) | 0.14 g/m$^2$ |
| Cyan Dye Donor Substance ($B_2$) | 0.21 g/m$^2$ |
| High Boiling Point Organic Solvent (1) | 0.19 g/m$^2$ |
| Reducing Agent | 0.024 g/m$^2$ |
| Mercapto Compound (1) | $5.9 \times 10^{-3}$ g/m$^2$ |
| Surfactant (3) | 0.029 g/m$^2$ |
| Gelatin | 0.41 g/m$^2$ |
| Water-Soluble Polymer (1) | 0.013 g/m$^2$ |
| Fourth Layer: Interlayer | |
| Gelatin | 0.56 g/m$^2$ |
| $Zn(OH)_2$ | 0.24 g/m$^2$ |
| Surfactant (1) | $8.7 \times 10^{-3}$ g/m$^2$ |
| Surfactant (4) | 0.046 g/m$^2$ |
| Water-Soluble Polymer (1) | 0.012 g/m$^2$ |
| Fifth Layer: Red (670 nm)-Sensitive Layer | |
| Emulsion (1) | 0.27 g/m$^2$ as Ag |
| Sensitizing Dye (1) | $8.5 \times 10^{-4}$ g/m$^2$ |
| Benzotriazole | $4.3 \times 10^{-3}$ g/m$^2$ |
| Magenta Dye Donor Substance (A) | 0.23 g/m$^2$ |
| High Boiling Point Organic Solvent (2) | 0.079 g/m$^2$ |
| Reducing Agent | 0.018 g/m$^2$ |
| Mercapto Compound (1) | $2.3 \times 10^{-3}$ g/m$^2$ |
| Surfactant (3) | $5.8 \times 10^{-3}$ g/m$^2$ |
| Gelatin | 0.29 g/m$^2$ |
| Water-Soluble Polymer (1) | $8.5 \times 10^{-3}$ g/m$^2$ |
| Sixth Layer: Protective Layer | |
| Gelatin | 1.09 g/m$^2$ |
| Mat Agent | 0.029 g/m$^2$ |
| Surfactant (1) | 0.063 g/m$^2$ |
| Surfactant (2) | 0.032 g/m$^2$ |
| Water-Soluble Polymer (1) | 0.016 g/m$^2$ |
| Hardening Agent | 0.038 g/m$^2$ |

Compounds used above are mentioned below.

Magenta Dye Donor Substance (A):

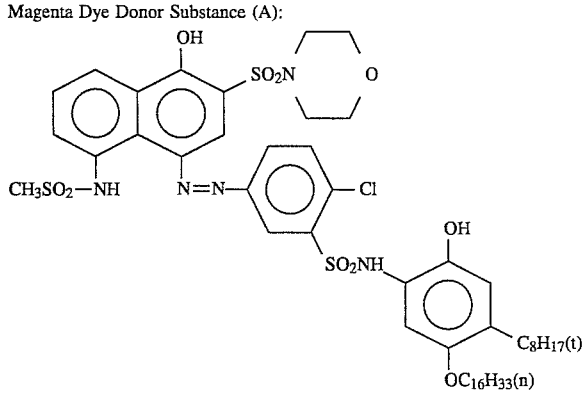

-continued
Cyan Dye Donor Substance ($B_1$):
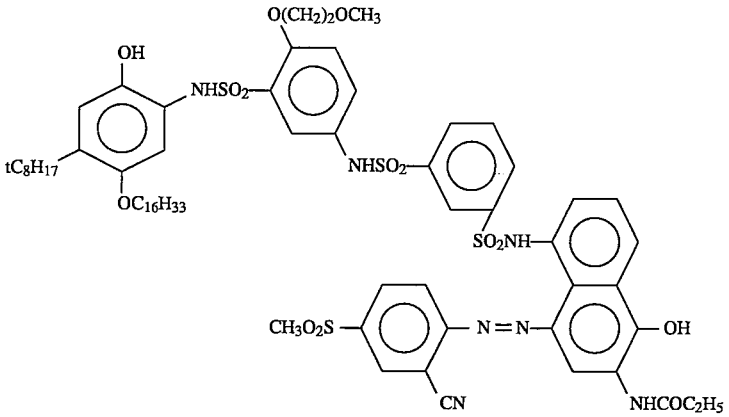
Cyan Dye Donor Substance ($B_2$):
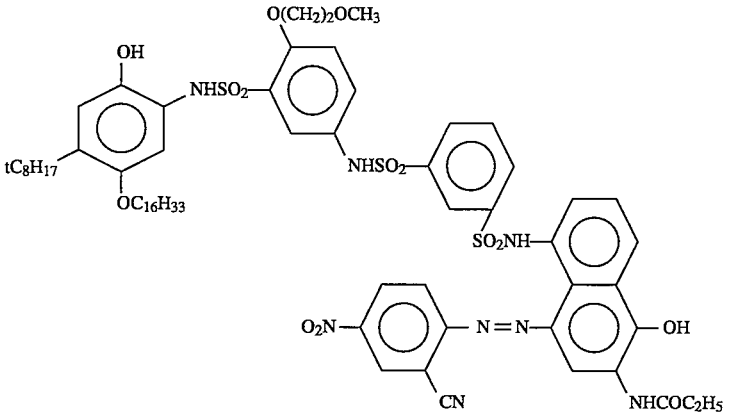
Yellow Dye Donor Substance (C):
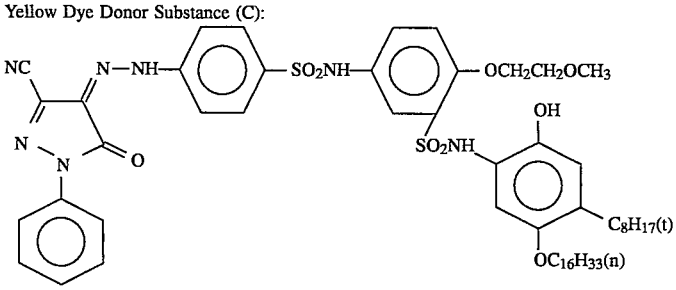
Reducing Agent:
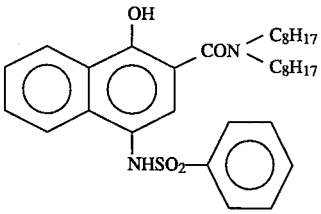
Mercapto Compound (1):
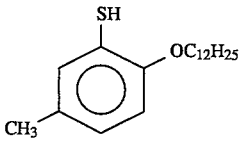
High Boiling Point Organic Solvent (1):
Triisononyl Phosphate -continued
High Boiling Point Organic Solvent (2):
Trihexyl Phosphate
Water-Soluble Polymer (1):
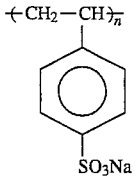
Surfactant (1):
Aerosol TO
Surfactant (2):
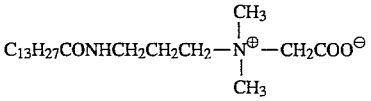
Surfactant (3):
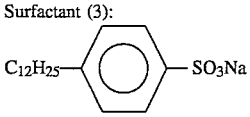
Surfactant (4):
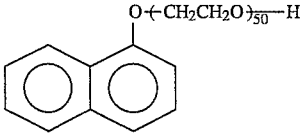
Hardening Agent:
$CH_2{=}CHSO_2CH_2SO_2CH{=}CH_2$
Sensitizing Dye (1):
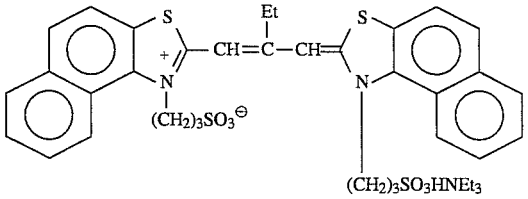
Sensitizing Dye (2):
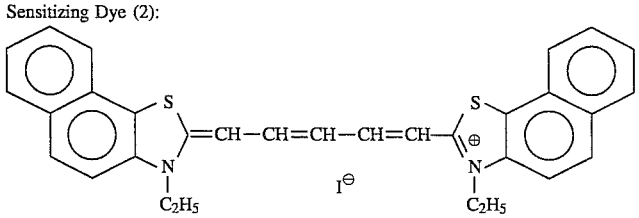
Sensitizing Dye (3):
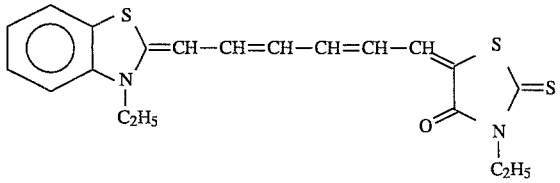
Mercapto Compound (2):
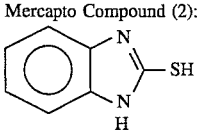

Next, photographic material samples 301 to 303 of the present invention were prepared in the same manner as in preparation of comparative sample 300, except that the composition of the first layer was varied to that shown in Table D below and no anti-halation layer was provided below the first layer.

TABLE D

| | 301 (mg/m²) | 302 (mg/m²) | 303 (mg/m²) |
|---|---|---|---|
| Emulsion (3) | 0.28 as Ag | 0.28 as Ag | 0.28 as Ag |
| Mercapto Compound (2) | $7.9 \times 10^{-4}$ | $7.9 \times 10^{-4}$ | $7.9 \times 10^{-4}$ |
| Sensitizing Dye (4) | $1.0 \times 10^{-4}$ | — | $1.0 \times 10^{-4}$ |
| Sensitizing Dye (3) | — | $3.5 \times 10^{-5}$ | — |
| Yellow Dye Donor Substance (C) | 0.35 | 0.35 | 0.35 |
| High Boiling Point Organic Solvent (1) | 0.18 | 0.18 | 0.18 |
| Reducing Agent | 0.028 | 0.028 | 0.028 |
| Mercapto Compound (1) | $3.5 \times 10^{-3}$ | $3.5 \times 10^{-3}$ | $3.5 \times 10^{-3}$ |
| Dye (F) | 0.046 | 0.09 | 0.05 |
| Surfactant (3) | 0.035 | 0.035 | 0.035 |
| Gelatin | 0.50 | 0.50 | 0.50 |
| Water-Soluble Polymer | 0.019 | 0.019 | 0.019 |
| Anti-Halation Layer | No | No | No |

Sensitizing dye (4) and Dye (F) used above are as mentioned below.

Sensitizing Dye (4):

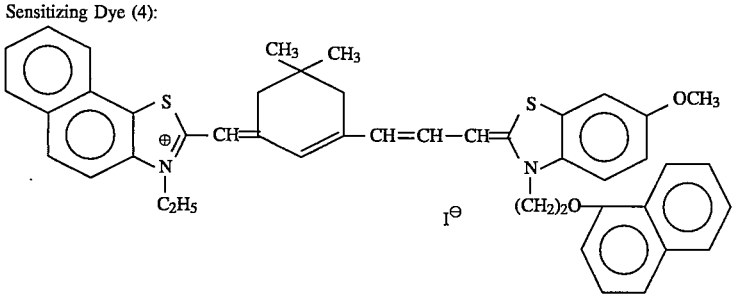

Dye (F):

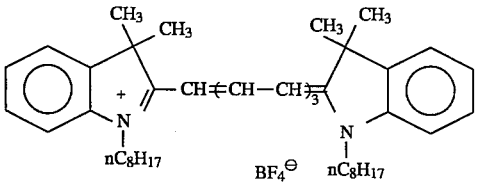

Dye (F) was incorporated into each sample along with yellow dye donor substance (C) in the form of a mixture dispersion of them.

The sensitivity of each of the fifth layer and the third layer of these samples was lowered to that shown in Table E below, by lowering the temperature in preparing emulsions (1) and (2) to 50° C. from 60° C.

TABLE E

| Sensitivity Difference | 300 (comparative example) | 301 (example of the invention) | 302 (example of the invention) | 303 (example of the invention) |
|---|---|---|---|---|
| (750 nm maximum sensitivity of 3rd layer)–(810 nm maximum sensitivity of 1st layer) | 0.9 logE | −0.1 logE | −0.1 logE | −0.1 logE |
| (670 nm maximum sensitivity of 5th layer)–(810 nm maximum sensitivity of 1st layer) | 1.8 logE | 0.8 logE | 0.8 logE | 0.8 logE |

A dye fixing material sample was prepared as mentioned below.

Three layers (first to third layers) each having the composition mentioned below were coated on one surface of a polyethylene-laminated paper support (thickness: 170 μm), and two backing layers each having the composition mentioned below were on the other surface of the same, to prepare dye fixing material sample R-2.

| Layer Constitution of Dye Fixing Material Sample R-2: | |
|---|---|
| First Layer: | |
| Gelatin | 0.45 g/m$^2$ |
| Surfactant (*4) | 0.01 g/m$^2$ |
| Polymer (*5) | 0.04 g/m$^2$ |
| Hardening Agent (*9) | 0.30 g/m$^2$ |
| Second Layer: | |
| Mordant Agent (*6) | 2.35 g/m$^2$ |
| Polymer (*7) | 0.60 g/m$^2$ |
| Gelatin | 1.40 g/m$^2$ |
| Polymer (*5) | 0.21 g/m$^2$ |
| High Boiling Point Solvent (*8) | 1.40 g/m$^2$ |
| Guanidine Picolinate | 1.80 g/m$^2$ |
| Surfactant (*2) | 0.02 g/m$^2$ |
| Third Layer: | |
| Gelatin | 0.05 g/m$^2$ |
| Silicone Oil (*1) | 0.04 g/m$^2$ |
| Surfactant (*2) | 0.001 g/m$^2$ |
| Surfactant (*3) | 0.02 g/m$^2$ |
| Surfactant (*4) | 0.10 g/m$^2$ |
| Guanidine Picolinate | 0.45 g/m$^2$ |
| Polymer (*5) | 0.24 g/m$^2$ |
| First Backing Layer: | |
| Gelatin | 3.25 g/m$^2$ |
| Hardening Agent (*9) | 0.25 g/m$^2$ |
| Second Backing Layer: | |
| Gelatin | 0.44 g/m$^2$ |
| Silicone Oil (*1) | 0.08 g/m$^2$ |
| Surfactant (*2) | 0.002 g/m$^2$ |
| Mat Agent (*10) | 0.09 g/m$^2$ |
| Surfactant (*11) | 0.01 g/m$^2$ |

Compounds used above are mentioned below.

Silicone Oil (*1):

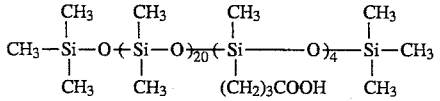

Surfactant (*2):

Aerosol TO

Surfactant (*3):

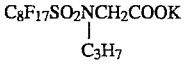

Surfactant (*4):

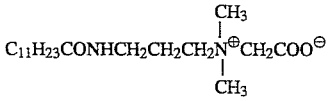

Surfactant (*11):

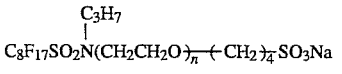

(n: ca. 4)

Polymer (*5):

Vinyl Alcohol-Sodium Acrylate (75/25, by mol) Copolymer

-continued

Polymer (*7):

Dextran (molecular weight: 70,000)

Mordant Agent (*6):

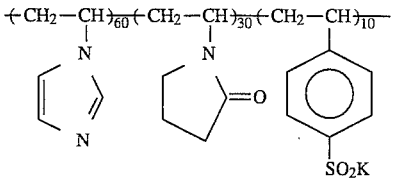

High Boiling Point Organic Solvent (*8):

Reofos 95 (product by Ajinomoto Co.)

Hardening Agent (*9):

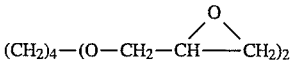

Mat Agent (*10):

Benzoguanamine Resin (having a proportion of large grains of 10 μm or more of being 18 vol %)

These samples were exposed in the manner mentioned below and the photographic properties of the samples were then evaluated.

Each sample was exposed to a laser ray, using the laser exposure apparatus as described in Japanese Patent Application No. 2-129625, under the condition mentioned in Table F below. 12 cc/m$^2$ of water was applied to the emulsion surface of each of the thus exposed samples, by wire bar coating. Then, the sample was attached to the dye fixing material sample R-2 prepared above, with the coated surfaces of the two facing each other. Using a heat drum, the combined samples were heated so that the water-applied surface of the sample had a temperature of 90° C. for 25 seconds. The photographic material sample was then peeled off from the dye-fixing material sample, whereby an image was formed on the latter.

TABLE F

| Condition for Laser Exposure | |
|---|---|
| Beam Strength on Sample | 1 mW |
| Scanning Line Density | 800 dpi (32 luster/nun) |
| Bean Diameter | 100 ± 10 μm in the main scanning direction<br>80 ± 10 μm in the sub-scanning direction |
| Exposure Time | 0.9 msec/luster |
| Laser Ray Wavelength for Exposure | 670 nm (laser ray)<br>750 nm (laser ray)<br>810 nm (laser ray) |
| Exposure Amount | 1 log E variation (for each track) per 2.5 cm in the sub-scanning direction |
| Method of Varying Exposure Amount | Emission Time Modulation |

To evaluate the time-dependent raw film stability of the samples, one group of samples was stored at room temperature for 3 days and the other group was stored under a temperature condition of 60° C. and a relative humidity of 60% for 3 days. The two groups were compared with each other.

To evaluate the whiteness of the background of each sample, the non-exposed area of each sample was measured with X-RITE (status A).

In each sample, yellow, magenta, cyan and intermediate gray (having a density of about 0.6) were continuously outputted for one day (24 hours), whereupon the color balance fluctuation of each sample, was evaluated.

With respect to the color separability, all the samples 300 to 303 had no problem.

The results obtained are shown in Table G below.

TABLE G

| Sample No. | Density of White Background, after stored at room temperature for 3 days | | | Density of White Background, after stored at 60° C. and 60% RH for 3 days | | | One-day Color Balance |
|---|---|---|---|---|---|---|---|
| | Cyan | Magenta | Yellow | Cyan | Magenta | Yellow | Fluctuation |
| 300 (comparative example) | 0.11 | 0.16 | 0.14 | 0.16 | 0.24 | 0.18 | Great |
| 301 (example of the invention) | 0.10 | 0.16 | 0.13 | 0.12 | 0.18 | 0.14 | Almost negligible |
| 302 (example of the invention) | 0.11 | 0.15 | 0.14 | 0.12 | 0.17 | 0.15 | Almost negligible |
| 303 (example of the invention) | 0.10 | 0.16 | 0.12 | 0.11 | 0.17 | 0.13 | Almost negligible |

From the results as above, it is seen that the samples of the present invention had an excellent time-dependent raw film stability and had little color balance fluctuation (with respect to dependence on temperature and water amount in development).

While the invention has been described in detail and with reference to specific embodiments thereof, it will be apparent to one skilled in the art that various changes and modifications can be made therein without departing from the spirit and scope thereof.

What is claimed is:

1. A diffusion transfer color photographic material comprising a light-sensitive silver halide emulsion, a binder, a non-diffusive dye donor compound capable of releasing or forming a diffusive dye in correspondence or reverse correspondence with reduction of silver halide to silver, and a ballasted non-diffusive filter dye which is not reactive to form a diffusible compound or moiety, on a support, wherein at least a portion of the filter dye and at least a portion of the dye donor compound are co-emulsified in an aqueous emulsified dispersion.

2. A diffusion transfer color photographic material as in claim 1, wherein the emulsified dispersion containing at least a portion of the filter dye and at least a portion of the dye donor compound is present in a layer containing the light-sensitive silver halide emulsion.

3. A diffusion transfer color photographic material as in claim 1, wherein the total dry thickness of the layers coated on the side of the support on which the silver halide emulsion is provided is 15 μm or less, the photographic material is developed by heat-development, and the processing temperature is from 50° C. to 250° C.

4. A diffusion transfer color photographic material as in claim 1, wherein the silver halide emulsion is a core/shell emulsion in which the inside phase and the surface phase of each grain are different from each other.

5. A diffusion transfer color photographic material as in claim 1, wherein the grain size of the emulsion is from 0.1 to 2 μm.

6. A diffusion transfer color photographic material as in claim 1, wherein the grain size is from 0.2 to 1.5 μm.

7. A diffusion transfer color photographic material as in claim 1, wherein the non-diffusive dye donor compound is represented by formula (LI):

$$(\text{Dye-Y})_n\text{-Z} \qquad \text{(LI)}$$

wherein Dye represents a dye group or dye precursor group whose wavelength has been shortened temporarily;

Y represents a chemical bond or a linking group;

Z represents a group which either causes an imagewise differential in the diffusibility of the compound $(\text{Dye-Y})_n$-Z in correspondence or reverse correspondence with a light-sensitive silver salt carrying a latent image or releases Dye and causes a differential in diffusibility between the released Dye and $(\text{Dye-Y})_n$-Z; and n represents 1 or 2, and when n is equal to 2, the two Dye-Y groups may be the same as or different from each other.

8. A diffusion transfer color photographic material as in claim 1, wherein the binder is hydrophilic.

9. A diffusion transfer color photographic material as in claim 1, wherein the binder is selected from transparent or semi-transparent hydrophilic binders.

* * * * *